US010132572B2

(12) United States Patent
Sakamaki et al.

(10) Patent No.: US 10,132,572 B2
(45) Date of Patent: Nov. 20, 2018

(54) HEAT EXCHANGE UNIT

(71) Applicant: DAIKIN INDUSTRIES, LTD., Osaka-shi, Osaka (JP)

(72) Inventors: Tomohiko Sakamaki, Osaka (JP); Yoshio Oritani, Osaka (JP); Shun Yoshioka, Osaka (JP); Tomoya Yamaguchi, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 15/721,265

(22) Filed: Sep. 29, 2017

(65) Prior Publication Data

US 2018/0094874 A1 Apr. 5, 2018

(30) Foreign Application Priority Data

Sep. 30, 2016 (JP) ..... 2016-193593

(51) Int. Cl.

| | |
|---|---|
| ***F28F 1/12*** | (2006.01) |
| ***F25D 21/14*** | (2006.01) |
| ***F28D 7/00*** | (2006.01) |
| ***F28F 1/04*** | (2006.01) |
| ***F28F 9/00*** | (2006.01) |

(Continued)

(52) U.S. Cl.

CPC ..... *F28F 1/12* (2013.01); *F25D 21/14* (2013.01); *F28D 7/0066* (2013.01); *F28F 1/04* (2013.01); *F28F 9/001* (2013.01); *F28F 9/02* (2013.01); *F28F 9/22* (2013.01)

(58) Field of Classification Search

CPC ..... F28F 1/12; F28F 9/02; F28F 9/22; F28F 9/001; F28F 1/04; F28F 2280/00; F28F 2280/10; F25D 21/14

See application file for complete search history.

(56) References Cited

U.S. PATENT DOCUMENTS 2,744,393 A * 5/1956 Brugler ..... F28D 7/08 165/137
3,000,193 A * 9/1961 Crider ..... F24F 5/001 165/48.1

(Continued)

FOREIGN PATENT DOCUMENTS

JP 2013-164216 A 8/2013

*Primary Examiner* — Cassey D Bauer

(74) *Attorney, Agent, or Firm* — Birch, Stewart, Kolasch & Birch, LLP

(57) ABSTRACT

A heat exchange unit includes a first heat exchanger and a second heat exchanger. The first heat exchanger has a plurality of first flattened tubes communicating at different heights with an individual space including a flow channel through which refrigerant is spouted upward when installation is in a first attitude. The second heat exchanger has a plurality of second flattened tubes communicating at different heights with an individual space including a flow channel through which refrigerant is spouted upward when installation is in the first attitude. The first heat exchanger is disposed so that refrigerant is spouted upward in a flow channel of the individual space also in the case of installation in a second attitude, and the second heat exchanger is disposed so that refrigerant is spouted upward in a flow channel of the individual space also in the case of installation in the second attitude.

12 Claims, 14 Drawing Sheets

(51) Int. Cl.
*F28F 9/22* (2006.01)
*F28F 9/02* (2006.01)

(56) References Cited

U.S. PATENT DOCUMENTS 3,299,660 A * 1/1967 Sullivan ..... F24F 1/0007 165/137
3,596,475 A * 8/1971 Berger ..... F24F 13/222 62/285
3,628,590 A * 12/1971 Knebusch ..... F24F 1/0007 165/101
3,722,580 A * 3/1973 Braver ..... F24F 1/0007 165/50
4,076,072 A * 2/1978 Bentz ..... F01P 3/18 165/41
4,088,466 A * 5/1978 Humphrey ..... F24F 13/22 62/286
4,129,013 A * 12/1978 Hine, Jr. ..... F24F 1/02 165/136
4,151,726 A * 5/1979 Schlueter ..... F24F 13/22 62/285
4,474,232 A * 10/1984 Wright ..... F24F 13/22 165/137
4,549,405 A * 10/1985 Anderson ..... B60H 1/00014 62/239
4,698,982 A * 10/1987 Laios ..... F24F 13/20 165/76
4,852,362 A * 8/1989 Conry ..... F25B 1/00 62/175
4,874,040 A * 10/1989 Herrmann ..... F24F 1/0007 165/122
5,121,613 A * 6/1992 Cox ..... F24F 1/0007 165/127
5,199,276 A * 4/1993 Sullivan ..... F24F 1/0007 220/571
5,228,197 A * 7/1993 Cox ..... F24F 1/0007 29/469
5,277,036 A * 1/1994 Dieckmann ..... F24F 3/044 165/76
5,284,027 A * 2/1994 Martin, Sr. ..... F24F 13/30 165/126
5,664,431 A * 9/1997 Martin, Sr. ..... F24F 13/22 62/286
5,927,096 A * 7/1999 Piccione ..... F24F 13/22 165/76
5,987,909 A * 11/1999 Martin, Sr. ..... F24F 13/222 62/288
6,073,686 A * 6/2000 Park ..... F28D 1/05391 165/110
6,276,443 B1 * 8/2001 Martin, Sr. ..... F28D 1/0477 165/124
6,360,817 B1 * 3/2002 Brochin ..... B60H 1/00328 165/140
6,901,766 B1 * 6/2005 Jin ..... F24F 1/0007 62/286
8,220,282 B2 * 7/2012 Hast ..... F25D 21/14 62/285
9,303,882 B2 * 4/2016 Hancock ..... F24F 3/0442
2006/0196635 A1 * 9/2006 Lesage ..... B21D 53/085 165/76
2015/0068711 A1 * 3/2015 Kashihara ..... F24F 13/20 165/121
2015/0071775 A1 * 3/2015 Kashihara ..... F24F 13/20 415/206
2016/0123682 A1 * 5/2016 Barbely ..... F24F 1/0007 312/236
2017/0045257 A1 * 2/2017 Moffitt ..... F28D 9/0093
2018/0094860 A1 * 4/2018 Sakamaki ..... F28D 1/0426
2018/0156542 A1 * 6/2018 Kolb ..... F28D 1/0417

* cited by examiner

HEAT EXCHANGE UNIT

TECHNICAL FIELD

The present invention relates to a heat exchange unit, particularly to a heat exchange unit that can be installed and used in mutually different first and second attitudes.

BACKGROUND ART

The heat exchange unit disclosed in Patent Literature 1 (Japanese Laid-open Patent Publication No. 2013-164216), for example, is conventionally known as a heat exchange unit which is provided with two heat exchangers inside thereof and can be used in two attitudes, including an attitude in which the heat exchange unit is vertical and the two heat exchangers are parallel in a horizontal direction, and an attitude in which the heat exchange unit is horizontal and the two heat exchangers are parallel in an up/down direction. Such a heat exchange unit may also use heat exchangers in which fins and flattened tubes are used, a fin communicating part being formed on one side of the fins, and notches for insertion of the flattened tubes being formed on the other side of the fins.

SUMMARY OF THE INVENTION

Problems that the Invention is Intended to Solve

However, in a configuration in which the heat exchangers of a heat exchange unit such as the heat exchange unit disclosed in Patent Literature 1 are only replaced with heat exchangers that use flattened tubes, refrigerant flowing to an internal space of a header or other refrigerant distribution space which is communicating with the flattened tubes and distributes refrigerant is sometimes spouted upward and sometimes spouted downward when the heat exchange unit is vertically placed or laterally placed, and irregularity in the direction of refrigerant flow also causes differences in the performance of the heat exchange unit.

The present invention addresses the problem of providing a heat exchange unit inside which a plurality of heat exchangers are provided, and which can be installed in either of two different attitudes, the heat exchange unit being capable of demonstrating good heat exchanging capacity in both of the two installation attitudes.

Solution to Problem

A heat exchange unit according to a first aspect of the present invention is a heat exchange unit capable of being installed and used in a first attitude and of being installed and used in a second attitude different from the first attitude, and comprises: a casing having a bottom face facing downward when the heat exchange unit is installed in the first attitude, and a predetermined side face intersecting with the bottom face, the predetermined side face facing downward when the heat exchange unit is in the second attitude; a first heat exchanger disposed inside the casing so that an inclined installation thereof is possible in both the first attitude and the second attitude; and a second heat exchanger disposed inside the casing so that an inclined installation thereof is possible in both the first attitude and the second attitude; the first heat exchanger having a first refrigerant distribution space including a flow channel through which refrigerant is spouted upward when the heat exchange unit is in the first attitude, and a plurality of first flattened tubes communicating with the first refrigerant distribution space at different heights; the second heat exchanger having a second refrigerant distribution space including a flow channel through which refrigerant is spouted upward when the heat exchange unit is in the first attitude, and a plurality of second flattened tubes communicating with the second refrigerant distribution space at different heights; the first heat exchanger being disposed inside the casing so that refrigerant is spouted upward in the flow channel of the first refrigerant distribution space also when the casing is installed in the second attitude; and the second heat exchanger being disposed inside the casing so that refrigerant is spouted upward in the flow channel of the second refrigerant distribution space also when the casing is installed in the second attitude.

In the heat exchange unit according to a first aspect of the present invention, the first heat exchanger and the second heat exchanger are configured so that refrigerant is spouted upward in the first refrigerant distribution space and the second refrigerant distribution space in both the first attitude and the second attitude, and no downward spouting by gravity occurs in the first refrigerant distribution space or the second refrigerant distribution space when in the first attitude or the second attitude. When refrigerant is spouted downward by gravity when distributed inside the first refrigerant distribution space and the second refrigerant distribution space, circulation of refrigerant is adversely affected due to a difference in specific gravity between gas refrigerant and liquid refrigerant. However, because refrigerant is invariably spouted upward in both the first refrigerant distribution space and the second refrigerant distribution space in both the first attitude and the second attitude, good circulation of refrigerant can be ensured, and high heat exchanging capacity is readily obtained in both the first attitude and the second attitude.

A heat exchange unit according to a second aspect of the present invention is the heat exchange unit according to the first aspect, wherein the first heat exchanger and the second heat exchanger are disposed so as to be inclined in the same direction and are disposed so that lower end parts thereof are closer to the predetermined side face than upper end parts thereof when the casing is installed in the first attitude.

In the heat exchange unit according to the second aspect of the present invention, the first heat exchanger and the second heat exchanger are disposed so as to be inclined in the same direction and are disposed so that the lower end parts thereof are closer to the predetermined side face than the upper end parts thereof when the heat exchange unit is installed in the first attitude, and the first heat exchanger and the second heat exchanger are therefore disposed so that the upper end parts thereof are farther from the predetermined side face than the lower end parts thereof when the heat exchange unit is installed in the second attitude.

A heat exchange unit according to a third aspect of the present invention is the heat exchange unit according to the first or second aspect of the present invention, wherein the first heat exchanger further has a plurality of first fins fitted into the plurality of first flattened tubes so as to intersect with the first flattened tubes, first fin communicating parts being formed on both sides of the first flattened tubes in a cross-sectional longitudinal direction thereof, and the second heat exchanger further has a plurality of second fins fitted into the plurality of second flattened tubes so as to intersect with the second flattened tubes, second fin communicating parts being formed on both sides of the second flattened tubes in a cross-sectional longitudinal direction thereof.

In the heat exchange unit according to the third aspect of the present invention, when a first heat exchanger in which first fin non-communicating parts and first fin communicating parts are on both sides thereof is turned while maintaining upward spouting, and the attitude thereof is switched between the first attitude and the second attitude, the first fin non-communicating parts face downward. However, such a state can be prevented by providing the first fin communicating parts to both sides of the first flattened tubes. In the same manner, when a second heat exchanger in which second non-communicating parts and second fin communicating parts are on both sides thereof is turned while maintaining upward spouting, and the attitude thereof is switched between the first attitude and the second attitude, the second fin non-communicating parts face downward. However, such a state can be prevented by providing the second fin communicating parts to both sides of the second flattened tubes.

A heat exchange unit according to a fourth aspect of the present invention is the heat exchange unit according to the third aspect, wherein, in the first heat exchanger, a plurality of first notches are formed for inserting the plurality of first flattened tubes into the plurality of first fins, the plurality of first flattened tubes and the plurality of first fins are arranged in two columns, and the plurality of first notches of a first column of the plurality of first fins and the plurality of first notches of a second column of the plurality of first fins are disposed so as to face each other; and, in the second heat exchanger, a plurality of second notches are formed for inserting the plurality of second flattened tubes into the plurality of second fins, the plurality of second flattened tubes and the plurality of second fins are arranged in two columns, and the plurality of second notches of a first column of the plurality of second fins and the plurality of second notches of a second column of the plurality of second fins are disposed so as to face each other.

In the heat exchange unit according to a fourth aspect of the present invention, in the first heat exchanger and the second heat exchanger in two columns, because the plurality of first notches are disposed so as to face each other, and the plurality of second notches are disposed so as to face each other, the first fin communicating parts on a reverse side from the first notches can be disposed on both sides of the first heat exchanger, and the second fin communicating parts on a reverse side from the second notches can be disposed on both sides of the second heat exchanger.

A heat exchange unit according to a fifth aspect of the present invention is the heat exchange unit according to any of the first through the fourth aspects, further comprising a first drain pan configured so as to be disposed under the first heat exchanger in both the first attitude and the second attitude in order to catch condensed water from the first heat exchanger, and a second drain pan configured so as to be disposed under the second heat exchanger in both the first attitude and the second attitude in order to catch condensed water from the second heat exchanger, the second heat exchanger being configured so as to be positioned above the first heat exchanger when the heat exchange unit is in the second attitude, and the second drain pan being configured so as to extend between the first heat exchanger and the second heat exchanger when the heat exchange unit is in the second attitude.

In the heat exchange unit according to the fifth aspect of the present invention, the second drain pan is configured so as to extend between the first heat exchanger and the second heat exchanger when the heat exchange unit is in the second attitude, and the second drain pan can therefore catch condensed water generated in the second heat exchanger so that the condensed water generated in the second heat exchanger does not come to the first heat exchanger.

Advantageous Effects of Invention

In the heat exchange unit according to the first aspect of the present invention, good heat exchanging capacity can be demonstrated in both the first attitude and the second attitude.

In the heat exchange unit according to the second aspect of the present invention, it is possible to easily realize a heat exchange unit which can be installed so that refrigerant is spouted upward in the first refrigerant distribution space as well as in the second refrigerant distribution space in not only the first attitude but also the second attitude.

In the heat exchange unit according to the third aspect of the present invention, it is possible to reduce a deterioration in heat exchanging capacity of the first heat exchanger and the second heat exchanger due to accumulation of condensed water in the first fin non-communicating parts and the second fin non-communicating parts.

In the heat exchange unit according to the fourth aspect of the present invention, a heat exchange unit having good drainage performance in both the first attitude and the second attitude can easily be obtained.

In the heat exchange unit according to the fifth aspect of the present invention, it is possible to reduce a deterioration in heat exchanging capacity in the first heat exchanger due to movement of condensed water generated in the second heat exchanger to the first heat exchanger.

DESCRIPTION OF EMBODIMENTS

First Embodiment (1) Overall Configuration of Heat Exchange Unit

Figure 1:
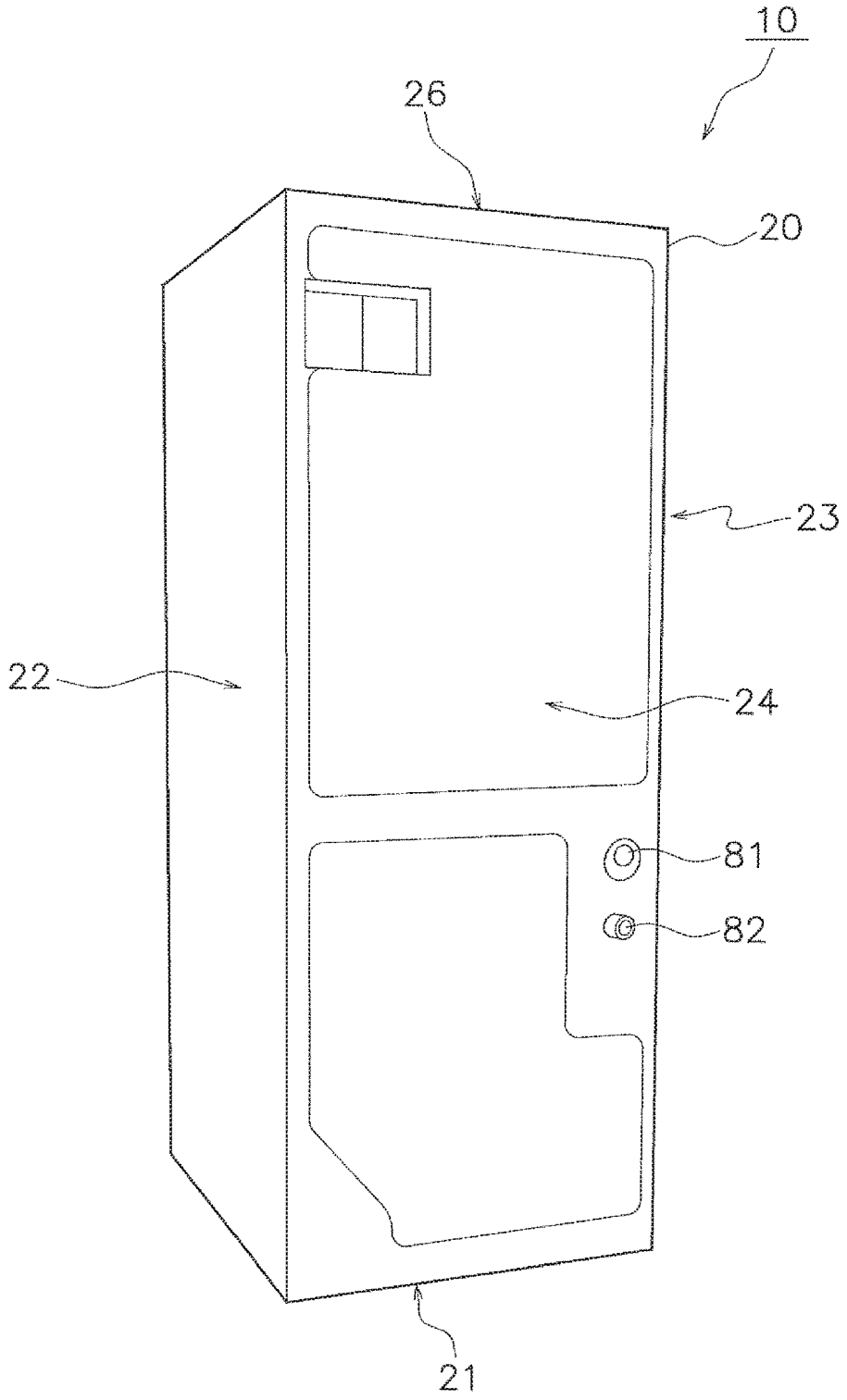
FIG. 1 is a perspective view illustrating the external appearance of the heat exchange unit according to an embodiment.
Figure 2:
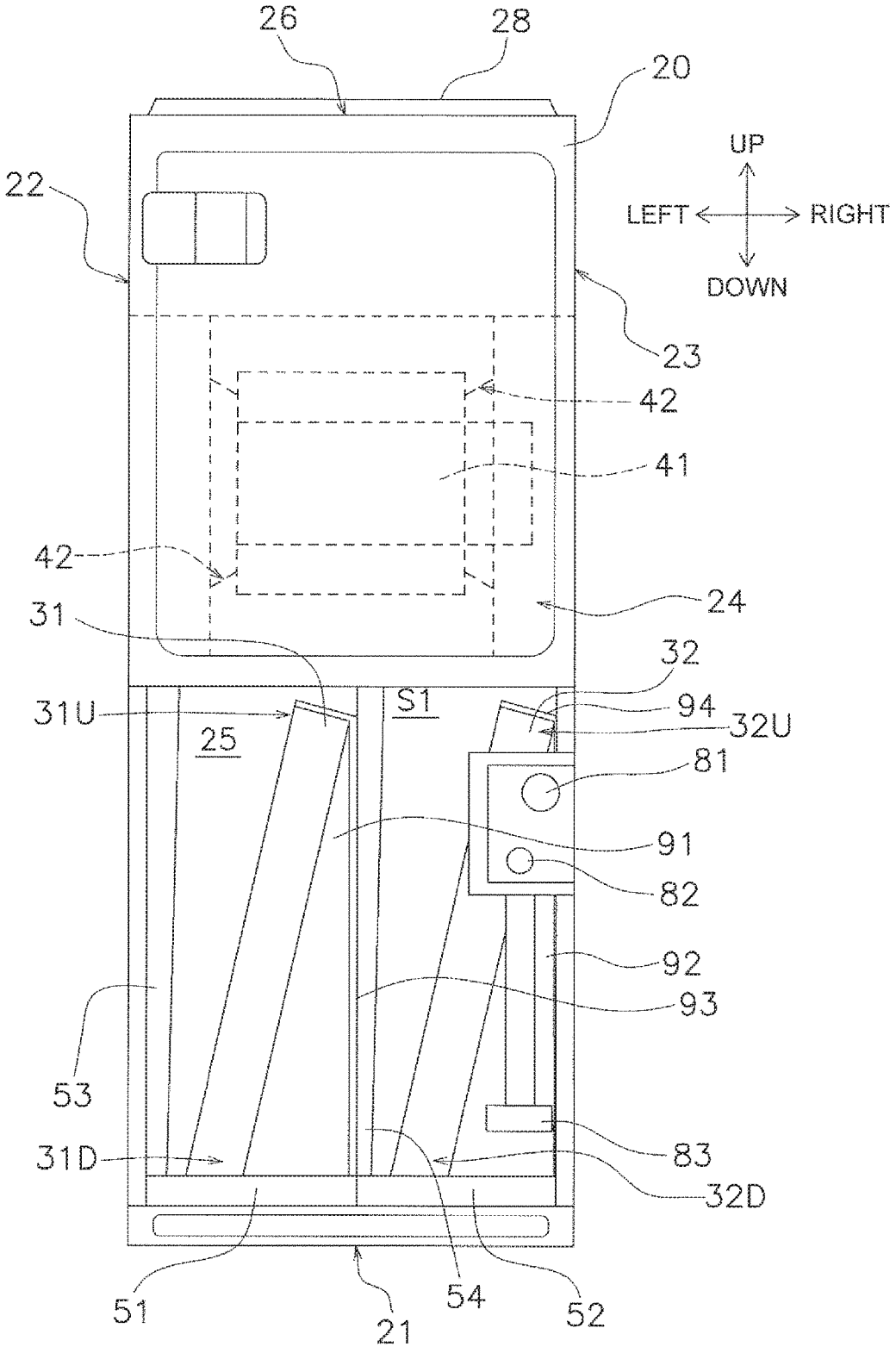
FIG. 2 is a front view illustrating the heat exchange unit in the first attitude, a front-side face thereof being partially removed.
Figure 3:
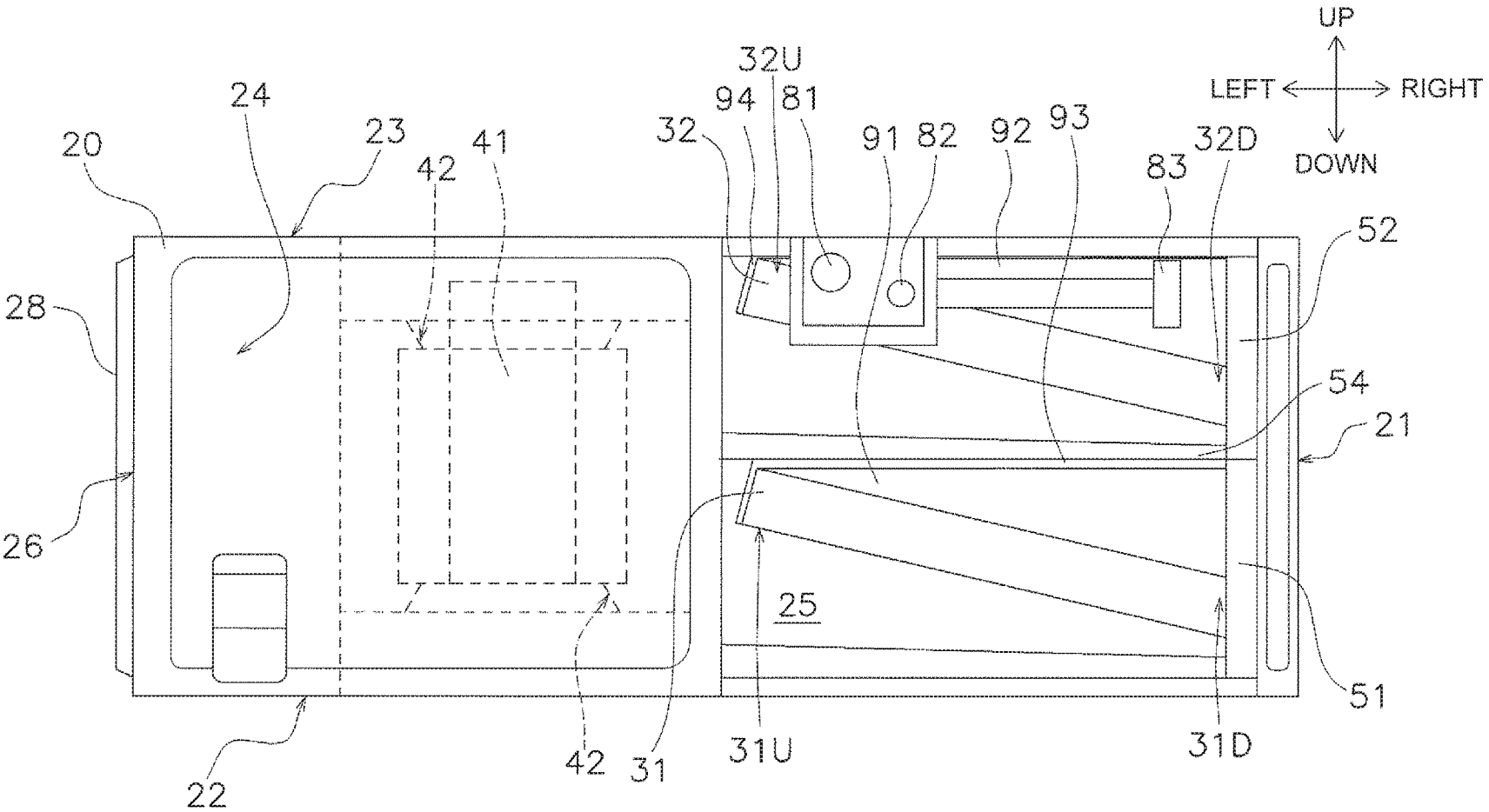
FIG. 3 is a front view illustrating the heat exchange unit in the second attitude, a front-side face thereof being partially removed.
Figure 4:
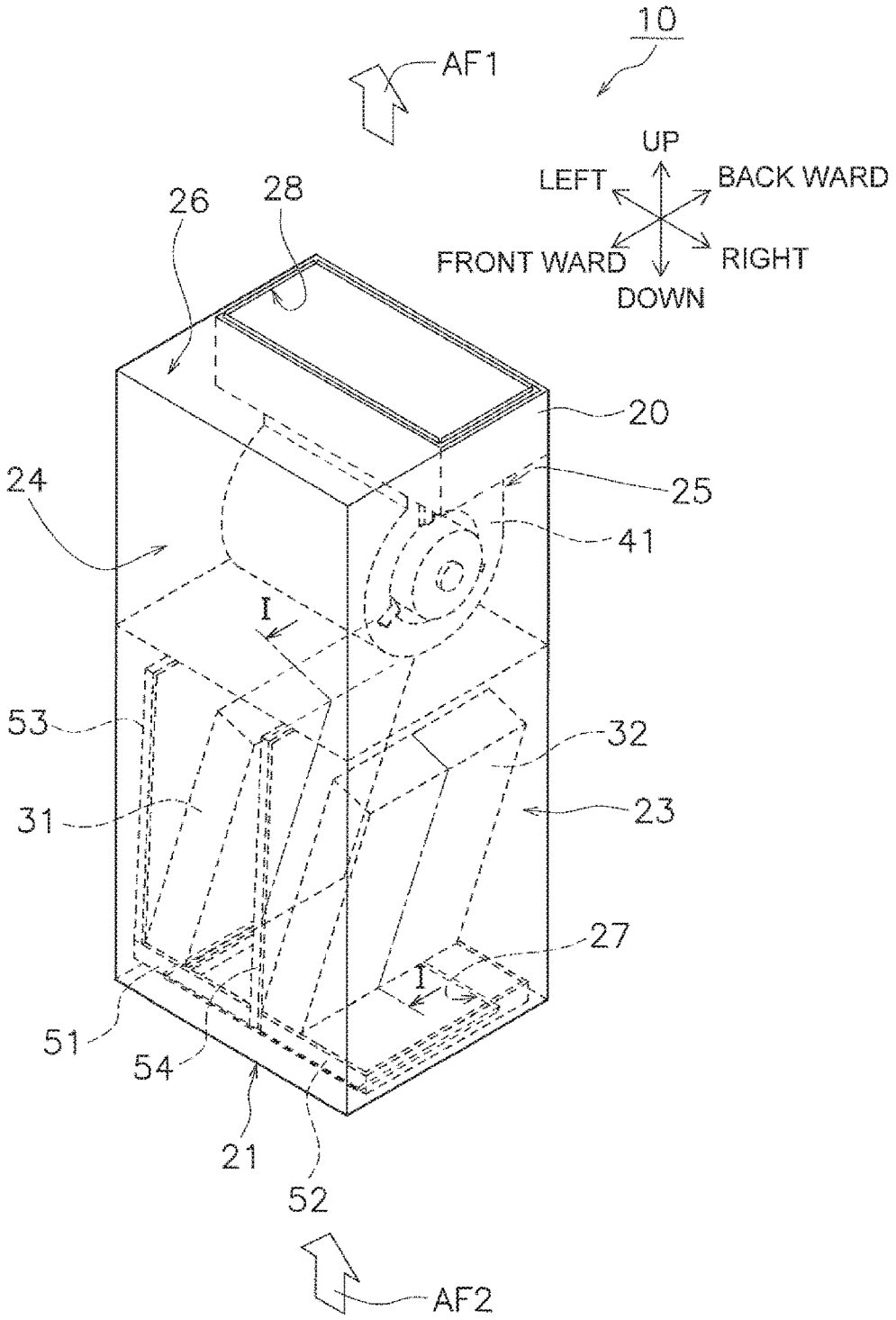
FIG. 4 is a perspective view of the heat exchange unit in the first attitude.

The external appearance of the heat exchange unit according to an embodiment of the present invention is illustrated in FIG. 1. The heat exchange unit 10 illustrated in FIG. 1 is provided with a casing 20. FIGS. 2 and 3 illustrate the heat exchange unit 10 installed in a first attitude and a second attitude, respectively. FIGS. 2 and 3 illustrate a state in which a portion of a front-side face 24 of the casing 20 is removed. The casing 20 of the heat exchange unit 10 has a bottom face 21, a left-side face 22, a right-side face 23, a front-side face 24, a rear-side face 25, and a top face 26. The heat exchange unit 10 can be installed and used in a first attitude in which the bottom face 21 of the casing 20 faces downward, as illustrated in FIG. 2. The heat exchange unit 10 can also be installed and used in a second attitude in which the left-side face 22 in the first attitude faces downward, as illustrated in FIG. 3. In the description below, the first attitude is referred to as a vertical attitude and the second attitude is referred to as a horizontal attitude, the term "vertical use" is used when the heat exchange unit 10 is installed and used in the first attitude, and the term "horizontal use" is used when the heat exchange unit 10 is installed and used in the second attitude. FIG. 4 is an oblique view from above illustrating the heat exchange unit 10 in the vertical attitude, and illustrates the internal state of the heat exchange unit 10 using dashed lines.

(2) Detailed Configuration of Heat Exchange Unit (2-1) Casing 20

The shape of the casing 20 is that of a rectangular parallelepiped having an opening as a suction port 27 in the bottom face 21 and an opening as a vent 28 in the top face 26 (see FIG. 4). The bottom face 21 and the top face 26, the left-side face 22 and the right-side face, and the front-side face 24 and the rear-side face 25, respectively, are parallel to each other. The left-side face 22, the right-side face 23, the front-side face 24 and rear-side face 25 are orthogonal to the bottom face 21 and top face 26. The casing 20 is set so that the bottom face 21 faces downward when the heat exchange unit is in the first attitude, whereas the left-side face 22 faces downward when the heat exchange unit is in the second attitude. The left-side face 22 thus configured is a predetermined side face. In other words, the casing 20 is configured so that the bottom face 21 and the left-side face 22 as the predetermined side face are orthogonal to each other. However, the bottom face 21 and the predetermined side face are not necessarily orthogonal in the present invention, and may also be disposed so as to intersect with each other. For example, a configuration may be adopted in which the casing 20 is not a rectangular parallelepiped shape, and the bottom face 21 and the left-side face 22 as the predetermined side face meet at an angle other than 90 degrees.

Inside the casing 20 in the vertical attitude, a first heat exchanger 31 and a second heat exchanger 32 are disposed above the suction port 27. A fan 41 is disposed above the first heat exchanger 31 and the second heat exchanger 32. A vent of the fan 41 is connected to the vent 28 of the casing 20. Air drawn in from the suction port 27 passes through the first heat exchanger 31 or the second heat exchanger 32, and is blown out from the vent 28 by the fan 41.

Inside the casing 20 in the vertical attitude, a bottom-face first drain pan 51 is disposed below the first heat exchanger 31, and a bottom-face second drain pan 52 is disposed below the second heat exchanger 32. Inside the casing 20 in the horizontal attitude, a left-face first drain pan 53 is disposed below the first heat exchanger 31, i.e., between the first heat exchanger 31 and the left-side face 22. Inside the casing 20 in the horizontal attitude, a left-face second drain pan 54 is disposed below the second heat exchanger 32, i.e., between the second heat exchanger 32 and the first heat exchanger 31.

(2-2) First Heat Exchanger 31 and Second Heat Exchanger 32

(2-2-1) Configuration of the First Heat Exchanger 31 and the Second Heat Exchanger 32

The first heat exchanger 31 and the second heat exchanger 32 are disposed inside the casing 20 so that an inclined installation thereof is possible in both the first attitude and the second attitude. The first heat exchanger 31 and the second heat exchanger 32 are disposed parallel to each other. In the heat exchange unit 10 in the vertical attitude (first attitude), both the first heat exchanger 31 and the second heat exchanger 32 are inclined downward to the left as viewed from the front (see FIG. 2). In the heat exchange unit 10 in the horizontal attitude (second attitude), both the first heat exchanger 31 and the second heat exchanger 32 are inclined downward to the right as viewed from the front (see FIG. 3). In the heat exchange unit 10, a configuration is adopted in which the first heat exchanger 31 and the second heat exchanger 32 are each inclined at the same angle with respect to the bottom face 21 (or the left-side face 22).

Figure 5:
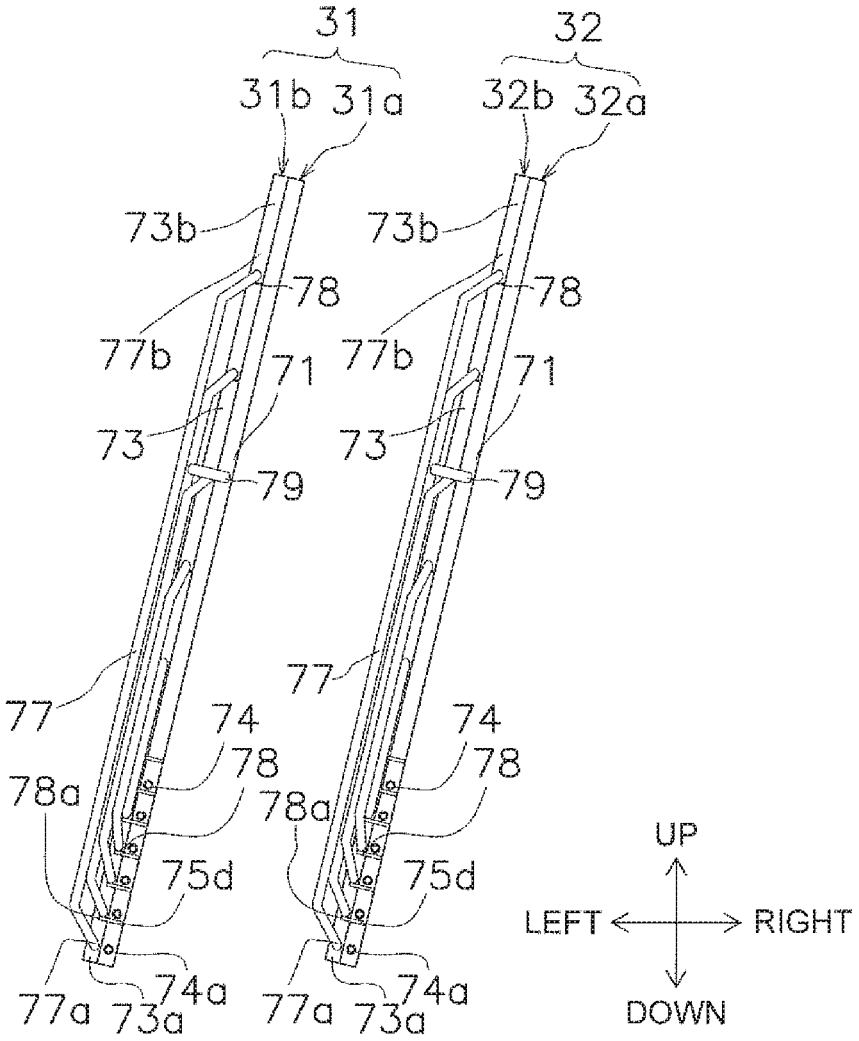
FIG. 5 is a front view of the first heat exchanger and the second heat exchanger inside the heat exchange unit illustrated in FIG. 1.
Figure 6:
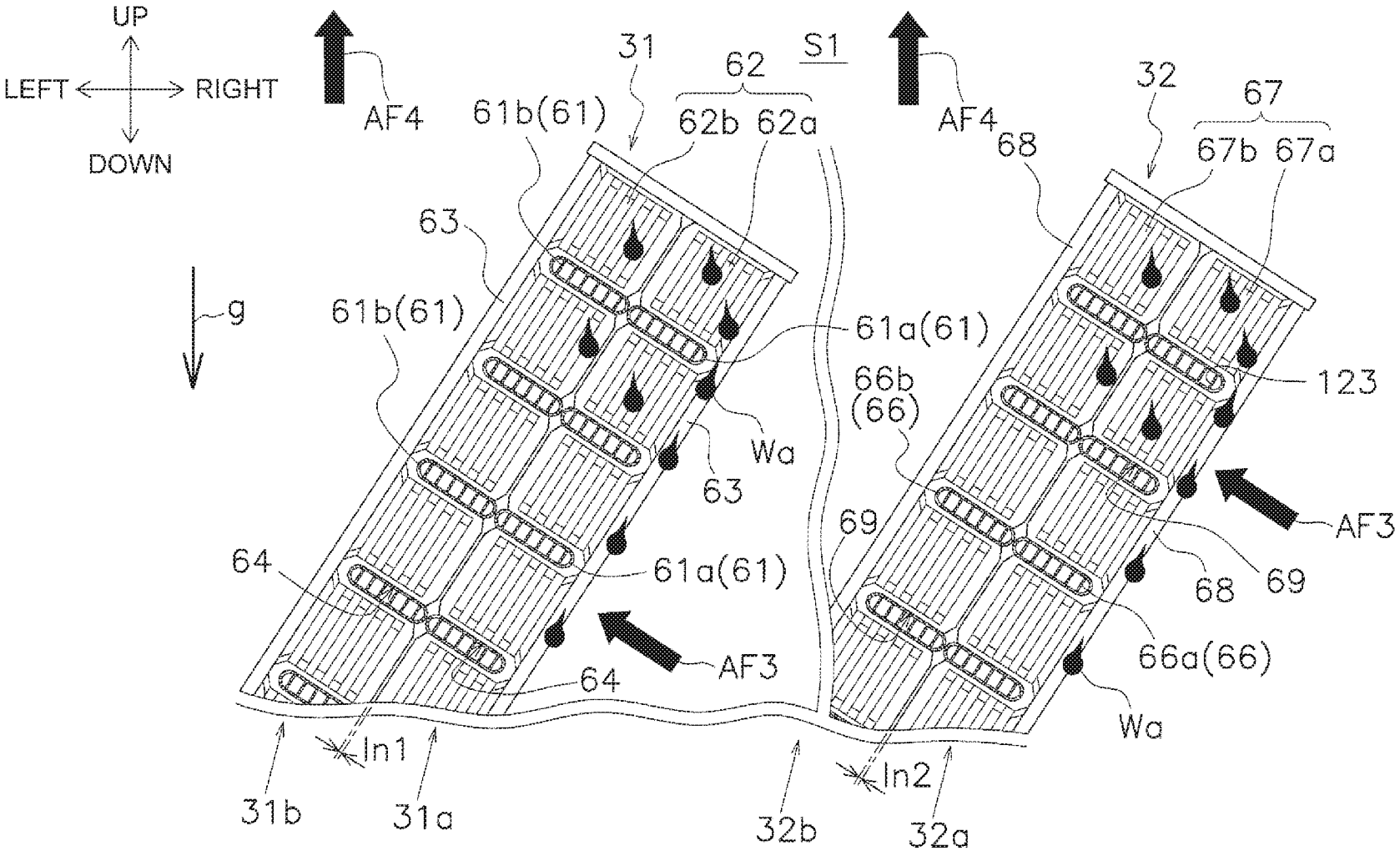
FIG. 6 is a partial enlarged sectional view of a portion of the first heat exchanger and a portion of the second heat exchanger in the first attitude, the sectional view being along line I-I in FIG. 4.
Figure 7:
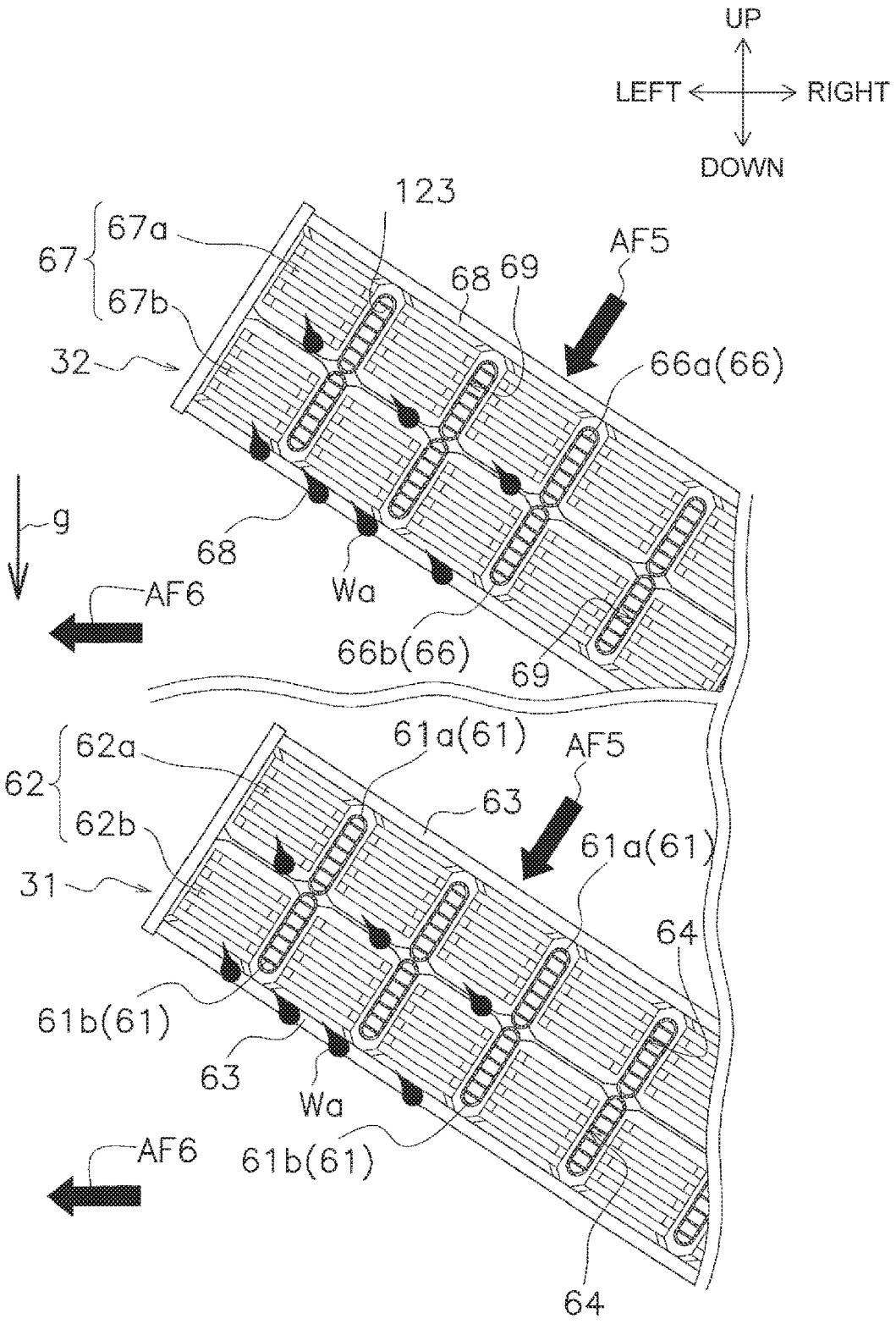
FIG. 7 is a partial enlarged sectional view of a portion of the first heat exchanger and a portion of the second heat exchanger in the second attitude, the sectional view being along line I-I in FIG. 4.

FIG. 5 illustrates a state in which only the first heat exchanger 31 and the second heat exchanger 32 are extracted and viewed from the front. The first heat exchanger 31 and the second heat exchanger 32 are disposed so as to be arranged on the left and right, respectively, as viewed from the front. A partial enlarged view of a cross-sectional shape of the first heat exchanger 31 and the second heat exchanger 32 along a line I-I in FIG. 4 drawn in the vertically oriented heat exchange unit 10 is illustrated in FIG. 6. Furthermore, FIG. 7 illustrates the cross-sectional shape of the first heat exchanger 31 and the second heat exchanger 32 at the same location in the case of the horizontally oriented heat exchange unit 10.

As illustrated in FIG. 5, the first heat exchanger 31 has two columns including a right-side column 31*a* and a left-side column 31*b*. As illustrated in FIGS. 6 and 7, first flattened tubes 61*a* and first fins 62*a* are disposed in the right-side column 31*a* of the first heat exchanger 31, and first flattened tubes 61*b* and first fins 62*b* are disposed in the left-side column 31*b* of the first heat exchanger 31. The plurality of first flattened tubes 61 are divided into the first flattened tubes 61*a* of the right-side column 31*a* arranged on the right side and the first flattened tubes 61*b* of the left-side column 31*b* arranged on the left side as the vertically oriented heat exchange unit 10 is viewed from the front side thereof. In the same manner, the plurality of first fins 62 are divided into the first fins 62*a* of the right-side column 31*a* inserted into the first flattened tubes 61*a*, and the first fins 62*b* of the left-side column 31*b* inserted into the first flattened tubes 61*b*. The first flattened tubes 61*a*, 61*b* are flattened perforated tubes in which a plurality of internal flow channels 123 per flattened tube are formed along a tube axial direction.

As illustrated in FIG. 5, the second heat exchanger 32 has two columns including a right-side column 32*a* and a left-side column 32*b*. As illustrated in FIGS. 6 and 7, second flattened tubes 66*a* and second fins 67*a* are disposed in the right-side column 32*a* of the second heat exchanger 32, and second flattened tubes 66*b* and second fins 67*b* are disposed in the left-side column 32*b* of the second heat exchanger 32. The plurality of second flattened tubes 66 are divided into the second flattened tubes 66*a* of the right-side column 32*a* arranged on the right side and the second flattened tubes 66*b* of the left-side column 32*b* arranged on the left side as the vertically oriented heat exchange unit 10 is viewed from the front side thereof. In the same manner, the plurality of second fins 67 are divided into the second fins 67*a* of the right-side column 32*a* inserted into the second flattened tubes 66*a*, and the second fins 67*b* of the left-side column 32*b* inserted into the second flattened tubes 66*b*. The second flattened tubes 66*a*, 66*b* are flattened perforated tubes in which a plurality of internal flow channels 123 per flattened tube are formed along a tube axial direction.

The first fins 62*a* of the right-side column 31*a* are shaped so as to be inserted into the first flattened tubes 61*a* of the right-side column 31*a* from a right side, and first fin communicating parts 63 of the first fins 62*a* are therefore disposed on a right side of the first flattened tubes 61*a* of the right-side column 31*a*. Consequently, left sides of first notches 64 in the first fins 62*a* of the right-side column 31*a* are open. The first fins 62*b* of the left-side column 31*b* are shaped so as to be inserted into the first flattened tubes 61*b* from a left side, and first fin communicating parts 63 of the first fins 62*b* of the left-side column 31*b* are therefore disposed on a left side of the first flattened tubes 61*b* of the left-side column 31*b*. Consequently, right sides of first notches 64 in the first fins 62*b* of the left-side column 31*b* are open.

The second fins 67*a* of the right-side column 32*a* are shaped so as to be inserted into the second flattened tubes 66*a* from the right side, and second fin communicating parts 68 of the second fins 67*a* are therefore disposed on the right side of the second flattened tubes 66*a* of the right-side column 32*a*. Consequently, left sides of second notches 69 in the second fins 67*a* of the right-side column 32*a* are open. The second fins 67*b* of the left-side column 32*b* are shaped so as to be inserted into the second flattened tubes 66*b* from the left side, and second fin communicating parts 68 of the second fins 67*b* of the left-side column 32*b* are therefore disposed on the left side of the second flattened tubes 66*b* of the left-side column 32*b*. Consequently, right sides of second notches 69 in the second fins 67*b* of the left-side column 32*b* are open.

The first notches 64 in the first fins 62*a* of the right-side column 31*a* of the first heat exchanger 31 and the first notches 64 in the first fins 62*b* of the left-side column 31*b* thereof are disposed so as to face each other. The second notches 69 in the second fins 67*a* of the right-side column 32*a* of the second heat exchanger 32 and the second notches 69 in the second fins 67*b* of the left-side column 32*b* thereof are also disposed so as to face each other. When viewed from a different angle, the first fin communicating parts 63 are disposed on the right side as well as on the left side of the first heat exchanger 31. The second fin communicating parts 68 are also disposed on the right side as well as on the left side of the second heat exchanger 32. Examining the first fins 62*a* of the right-side column 31*a* (first column) and the first fins 62*b* of the left-side column 31*b* (second column) in further detail, a gap In1 is formed between the first fins 62*a* of the first column and the first fins 62*b* of the second column (see FIG. 6). Examining the second fins 67*a* of the right-side column 32*a* (first column) and the second fins 67*b* of the left-side column 32*b* (second column) in the same manner, a gap In2 is formed between the second fins 67*a* of the first column and the second fins 67*b* of the second column (see FIG. 6). Using the gaps In1, In2 as a passage route for condensed water enhances condensed water drainage performance.

In the first heat exchanger 31 and second heat exchanger 32 configured such as described above, the first fin communicating parts 63 of the first fins 62*a* of the right-side column 31*a* are disposed below the first heat exchanger 31, and the second fin communicating parts 68 of the second fins 67*a* of the right-side column 32*a* are disposed below the second heat exchanger 32 when the heat exchange unit 10 is installed in the vertical attitude. When the heat exchange unit 10 is installed in the horizontal attitude, the first fin communicating parts 63 of the first fins 62*b* of the left-side column 31*b* are disposed below the first heat exchanger 31, and the second fin communicating parts 68 of the second fins 67*b* of the left-side column 32*b* are disposed below the second heat exchanger 32. Consequently, the first fin communicating parts 63 are downward in the first heat exchanger 31, and the second fin communicating parts 68 are downward in the second heat exchanger 32 in both the vertical attitude (first attitude) and the horizontal attitude (second attitude) of the heat exchange unit 10. As a result, condensed water is smoothly drained to the bottom-face first drain pan 51, the bottom-face second drain pan 52, the left-face first drain pan 53, or the left-face second drain pan 54 through the first fin communicating parts 63 and the second fin communicating parts 68 in both the vertical attitude (first attitude) and the horizontal attitude (second attitude) of the heat exchange unit 10. In FIGS. 6 and 7, the direction of gravity is indicated by an arrow g, and condensed water is conceptually represented by teardrop-shaped black spots as indicated by Wa.

(2-2-2) Flow of Refrigerant in the First Heat Exchanger 31 and the Second Heat Exchanger 32

An example of the flow of refrigerant in the first heat exchanger 31 and the second heat exchanger 32 will next be described using FIGS. 8 through 11. A thickness of an external periphery of an inlet/outlet header collecting tube 71 is omitted in FIG. 11 in order to facilitate understanding of an internal structure. Here, the flow of refrigerant is the same in the first heat exchanger 31 and the second heat exchanger 32, and will therefore be described using the first heat exchanger 31 as an example. The same reference numerals are used to refer to portions of the second heat exchanger 32 that have the same functions as in the first heat exchanger 31. In the first heat exchanger 31, an inlet/outlet header collecting tube 71 is disposed on a front side of the right-side column 31*a*, a return header collecting tube 72 is disposed on a rear side of the right-side column 31*a* and the left-side column 31*b*, and a loop header collecting tube 73 is disposed on a front side of the left-side column 31*b*.

The first heat exchanger 31 is divided into an upper part and a lower part by a boundary line BL1. A ratio of liquid refrigerant is higher for refrigerant flowing through the lower part of the first heat exchanger 31 than for refrigerant flowing through the upper part. A plurality of inlet pipings 74 are connected to a lower part of the inlet/outlet header collecting tube 71. Six inlet pipings 74 are illustrated herein. Arrows Ar1 in FIG. 8 indicate inflow of refrigerant from the inlet pipings 74. A plurality of individual spaces 71*a* partitioned by a plurality of baffles 75 and a partition plate 76 are formed inside the inlet/outlet header collecting tube 71. The partition plate 76 is provided inside the inlet/outlet header collecting tube 71 and is disposed so as to divide the inside of the inlet/outlet header collecting tube 71 into front and rear portions along a longitudinal direction of the inlet/outlet header collecting tube 71.

A baffle 75*a* disposed below the inlet pipings 74 blocks all flow in an up/down direction inside the inlet/outlet header collecting tube 71. A baffle 75*c* is disposed above the inlet pipings 74, and a 75*b* is disposed further above the baffle 75*c*. The baffle 75*b* also blocks all flow in the up/down direction inside the inlet/outlet header collecting tube 71, the same as the baffle 75*a*. The plurality of first flattened tubes 61*a* of the right-side column 31*a* are connected to the inlet/outlet header collecting tube 71 between the two baffles 75*a*, 75*b*. Openings 76*a*, 76*b*, 76*c* for allowing refrigerant to pass through to a front and rear are also formed in the partition plate 76. Refrigerant flowing from the inlet pipings 74 to the inlet/outlet header collecting tube 71 between the two baffles 75*a*, 75*b* can flow to the front and rear of the partition plates 76 through the openings 76*a*, 76*b*, 76*c*, and flows out from the inlet/outlet header collecting tube 71 to the plurality of first flattened tubes 61*a*.

Refrigerant flowing in from the inlet pipings 74 flows toward the front of the partition plate 76 through the opening 76*a*. A portion of the refrigerant passed through the opening 76*a* subsequently flows out from the inlet/outlet header collecting tube 71 through the first flattened tubes 61*a* between the baffles 75*a*, 75*c*, but a remainder of the refrigerant passed through the opening 76*a* is jetted upward (in a direction of the baffle 75*b*) through an opening 75*ca* in the baffle 75*c*. As a result, an upward (in a direction indicated by an arrow Ar2) flow of refrigerant is formed along the partition plate 76.

This upward flow of refrigerant along the partition plate 76 impinges against the baffle 75*b* and changes direction, and induces a flow of refrigerant from a rear to a front (flow in a direction of an arrow Ar3) of the partition plate 76 through the opening 76*b*. This flow of refrigerant indicated by the arrow Ar3 induces a flow of refrigerant indicated by an arrow Ar4 downward along the partition plate 76, on the front side of the partition plate 76. Refrigerant headed downward along the partition plate 76 flows to the front of the partition plate 76 (flows as indicated by an arrow Ar5) through the opening 76*c*, and merges with the upward flow of refrigerant indicated by the arrow Ar2 along the partition plate 76. The flow of refrigerant from the inlet pipings 74 through the inlet/outlet header collecting tube 71 and toward the first flattened tubes 61*a* below the boundary line BL1 thus generates a flow of refrigerant which circulates in the inlet/outlet header collecting tube 71 (circulating flow indicated by the arrows Ar2, Ar3, Ar4, Ar5).

In the first flattened tubes 61*a* below the boundary line BL1, refrigerant flows from the inlet/outlet header collecting tube 71 to the return header collecting tube 72 in a direction indicated by an arrow Ar6. In the return header collecting tube 72, refrigerant flows from the plurality of first flattened tubes 61*a* of the right-side column 31*a* below the boundary line BL1 to the plurality of first flattened tubes 61*b* of the left-side column 31*b* below the boundary line BL1. At this time, the refrigerant in six first flattened tubes 61*a* of the right-side column 31*a*, for example, is returned to the same number of any of the first flattened tubes 61*b* of the left-side column 31*b*. The return of refrigerant by the return header collecting tube 72 below the boundary line BL1 is indicated conceptually by an arrow Ar7. Refrigerant flowing through the first flattened tubes 61*b* of the left-side column 31*b* below the boundary line BL1 is indicated by an arrow Ar8.

Refrigerant returned in a lower part below the boundary line BL1 flows into a lower part of the loop header collecting tube 73 below the boundary line BL1. In the loop header collecting tube 73, refrigerant flows through an interconnection piping 77 from the lower part of the loop header collecting tube 73 below the boundary line BL1 to an upper part of the loop header collecting tube 73 above the boundary line BL1. In other words, the lower part and upper part of the loop header collecting tube 73 are connected by a plurality of interconnection pipings 77 (five interconnection pipings 77 herein). In the individual spaces above and below the boundary line BL1, refrigerant flows directly through the inside of the loop header collecting tube 73 upward from below the boundary line BL1. The lower part as well as the upper part of the loop header collecting tube 73 are partitioned by baffles 78. For example, refrigerant flowing in from a lowermost inlet piping 74*a* and entering a lowermost individual space 71*a* below a lowermost baffle 75*d* in the inlet/outlet header collecting tube 71 is returned by the return header collecting tube 72, and enters a lowermost individual space 73*a* below a lowermost baffle 78*a* of the loop header collecting tube 73. Refrigerant enters from a lowermost entrance 77*a* among the plurality of interconnection pipings 77 from the lowermost individual space 73*a* of the loop header collecting tube 73, and flows out to an uppermost individual space 73*b* from an uppermost outlet 77*b*. A flow of refrigerant from the lower part of the loop header collecting tube 73 to the upper part thereof through the plurality of interconnection pipings 77 is indicated by an arrow Ar9.

Above the boundary line BL1, refrigerant flows from the loop header collecting tube 73 to the return header collecting tube 72 through the first flattened tubes 61*b* of the left-side column 31*b*. This flow of refrigerant from the loop header collecting tube 73 to the return header collecting tube 72 is indicated by an arrow Ar10.

In the return header collecting tube 72, refrigerant flows from the plurality of first flattened tubes 61*b* of the left-side column 31*b* above the boundary line BL1 to the plurality of first flattened tubes 61*a* of the right-side column 31*a* above the boundary line BL1. At this time, the refrigerant in a plurality of first flattened tubes 61*b* of the left-side column 31*b*, for example, is returned to any of the same number of the first flattened tubes 61*a* of the right-side column 31*a*. The return of refrigerant by the return header collecting tube 72 above the boundary line BL1 is indicated conceptually by an arrow Ar11. Refrigerant flowing through the first flattened tubes 61*a* of the right-side column 31*a* above the boundary line BL1 is indicated by an arrow Ar12.

Refrigerant returned in an upper part of the return header collecting tube 72 above the boundary line BL1 flows into an upper part of the inlet/outlet header collecting tube 71 above the boundary line BL1. There are no baffles in the upper part of the inlet/outlet header collecting tube 71. Refrigerant which has flowed into the upper part of the inlet/outlet header collecting tube 71 is collected in the upper part of the inlet/outlet header collecting tube 71, and flows out to the outside of the first heat exchanger 31 through a single outlet piping 79. This flow through the outlet piping 79 is indicated by an arrow Ar13.

A refrigerant outlet 81 and a refrigerant inlet 82 are provided in the front-side face 24 of the casing 20. Refrigerant passing through the outlet piping 79 of the first heat exchanger 31 and refrigerant passing through the outlet piping 79 of the second heat exchanger 32 merge and refrigerant passing through the refrigerant outlet 81 flows out of the casing 20. Refrigerant flowing into the casing 20 from the refrigerant inlet 82 is divided by a flow distributor 83, and flows into the first heat exchanger 31 and the second heat exchanger 32 from the inlet pipings 74 of the first heat exchanger 31 and the second heat exchanger 32. Description of the inlet pipings 74 extending to the flow distributor 83 are omitted in FIGS. 2 and 3.

Figure 14:
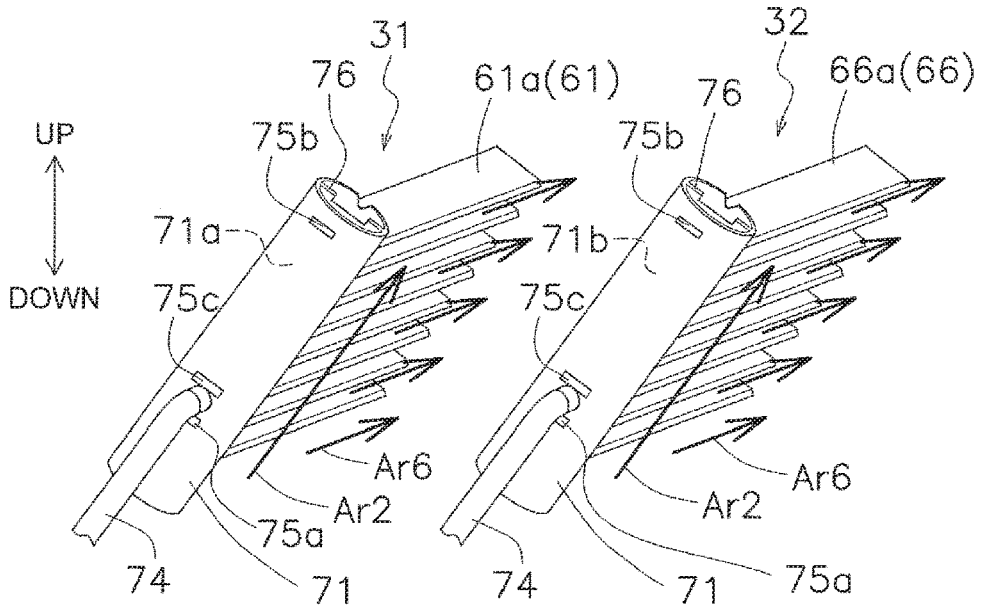
FIG. 14(*a*) is an enlarged perspective view illustrating a portion of the inlet/outlet header collecting tubes, the first flattened tubes, and the second flattened tubes in the first attitude, and FIG. 14(*b*) is an enlarged perspective view illustrating a portion of the inlet/outlet header collecting tubes, the first flattened tubes, and the second flattened tubes in the second attitude.
Figure 14:
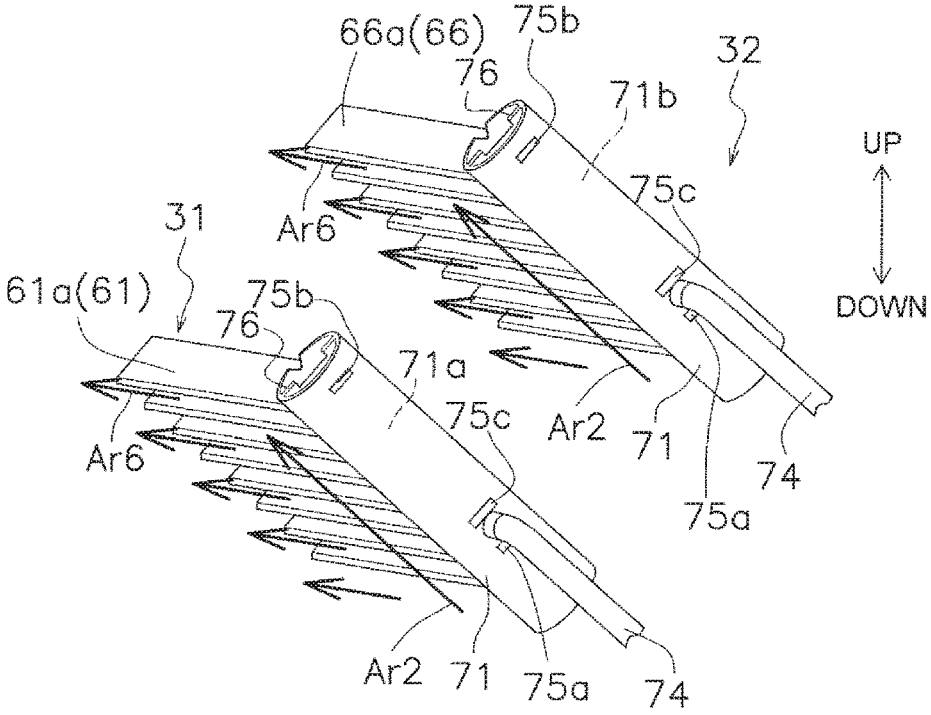

(2-2-3) Attitude of the Heat Exchange Unit 10 and Flow of Refrigerant therein FIG. 14(*a*) illustrates the lower part of the inlet/outlet header collecting tube 71 of the first heat exchanger 31 and the lower part of the inlet/outlet header collecting tube 71 of the second heat exchanger 32 in the vertical attitude illustrated in FIG. 6. FIG. 14(*a*) also illustrates the lower part of the inlet/outlet header collecting tube 71 of the first heat exchanger 31 and the lower part of the inlet/outlet header collecting tube 71 of the second heat exchanger 32 in the horizontal attitude illustrated in FIG. 7. In order to illustrate the inclination of the inlet/outlet header collecting tubes 71 of the first heat exchanger 31 and the second heat exchanger 32, FIGS. 14(*a*) and 14(*b*) do not correctly illustrate a distance between the first heat exchanger 31 and the second heat exchanger 32.

As previously described using FIGS. 8 through 11, the plurality of first flattened tubes 61*a* communicate at different heights in the individual space 71*a* between the baffles 75*a*, 75*b* of the inlet/outlet header collecting tube 71 of the first heat exchanger 31 illustrated in FIG. 14(*a*). In particular, a rear side of the partition plate 76 of the individual space 71*a* in which the plurality of first flattened tubes 61*a* communicate at different heights constitutes a flow channel in which refrigerant is spouted upward in the individual space 71*a*. In the same manner, the plurality of second flattened tubes 66*a* communicate at different heights in an individual space 71*b* between the baffles 75*a*, 75*b* of the inlet/outlet header collecting tube 71 of the second heat exchanger 32 illustrated in FIG. 14(*a*). In particular, a rear side of the partition plate 76 of the individual space 71*b* in which the plurality of second flattened tubes 66*a* communicate at different heights constitutes a flow channel in which refrigerant is spouted upward in the individual space 71*b*.

Figure 8:
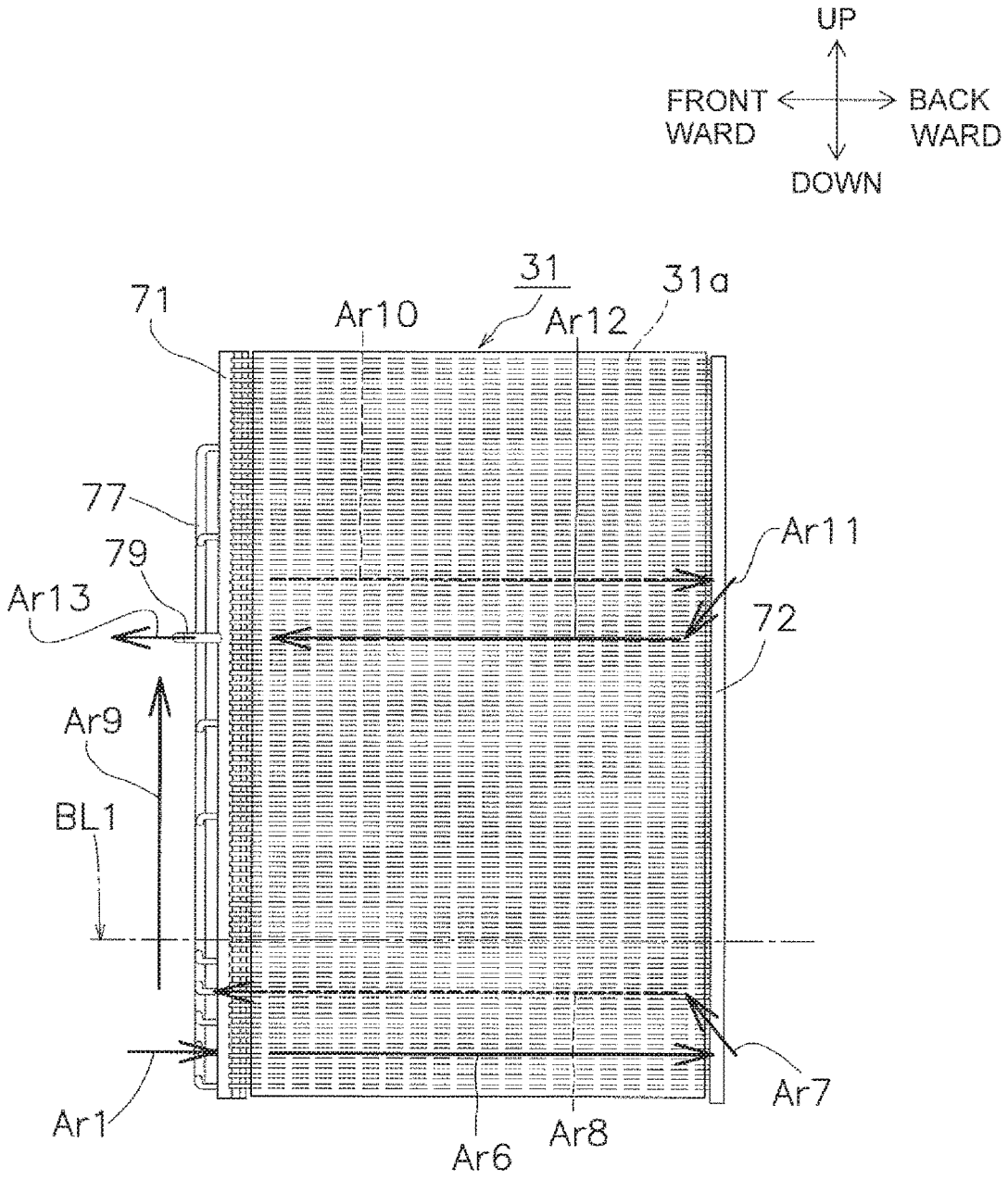
FIG. 8 is a side view of the first heat exchanger, illustrating the flow of refrigerant in the first heat exchanger.
Figure 9:
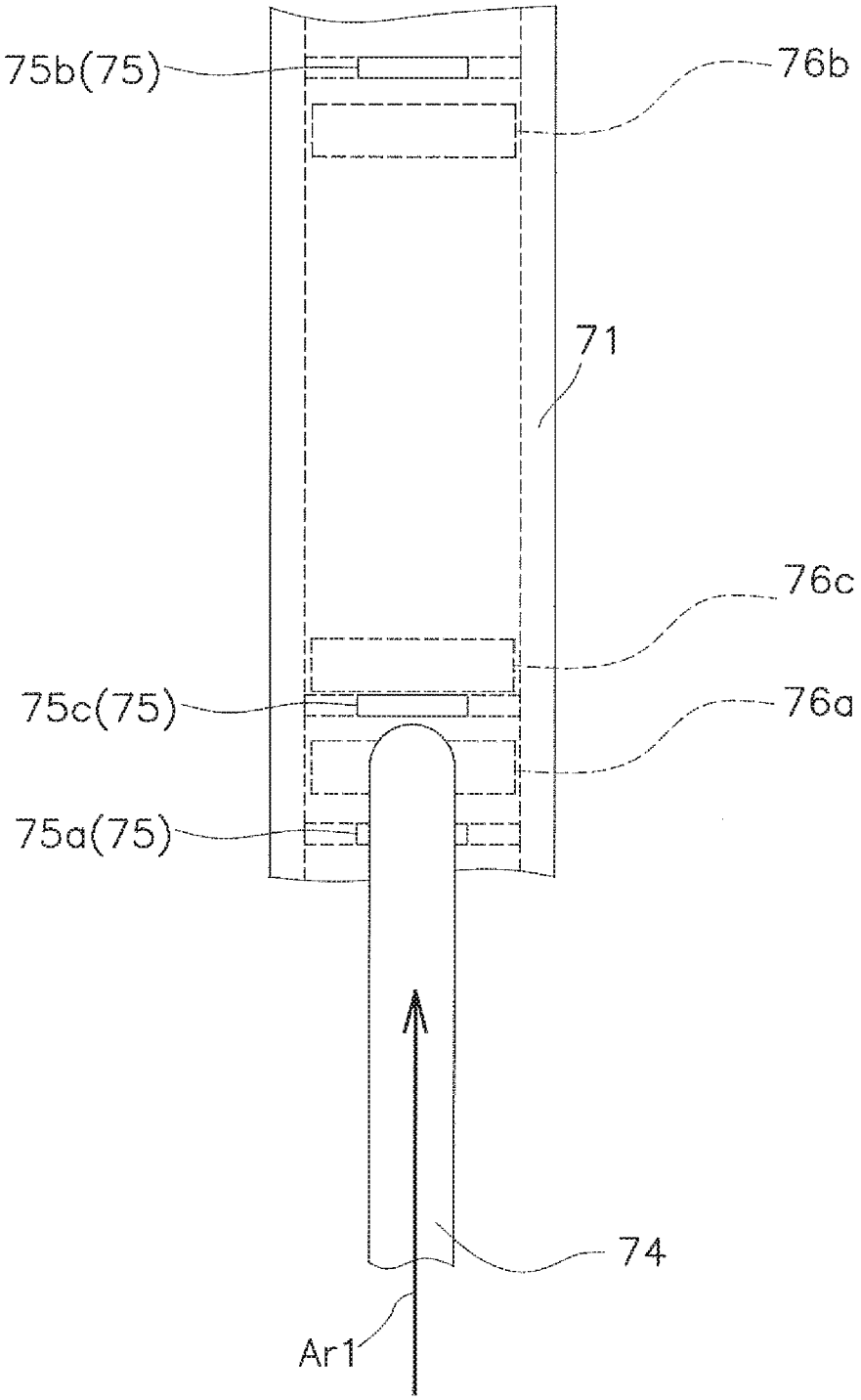
FIG. 9 is a partial enlarged front view of an inlet/outlet header collecting tube of the first heat exchanger.
Figure 10:
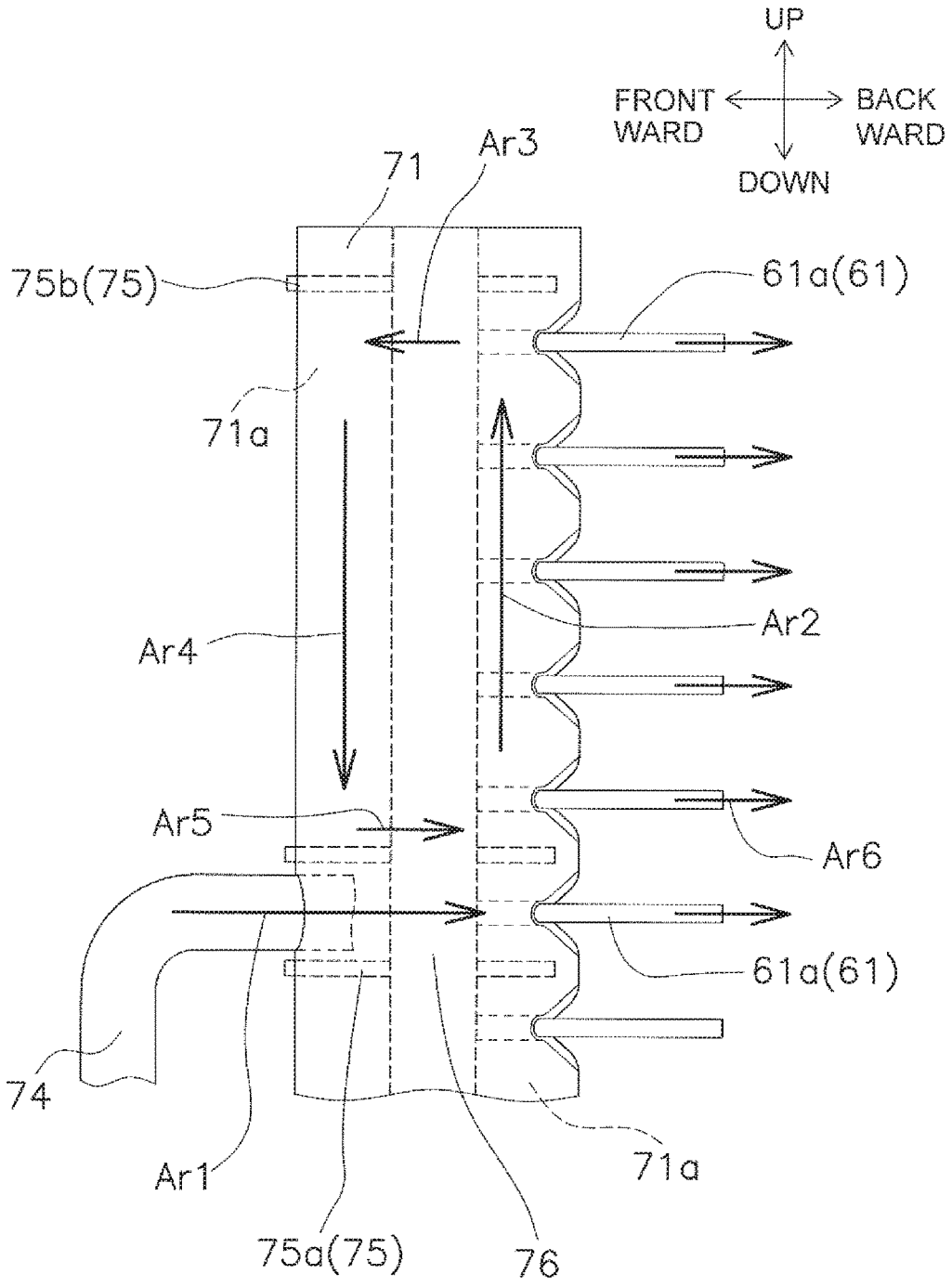
FIG. 10 is a partial enlarged side view of the inlet/outlet header collecting tube of the first heat exchanger.
Figure 11:
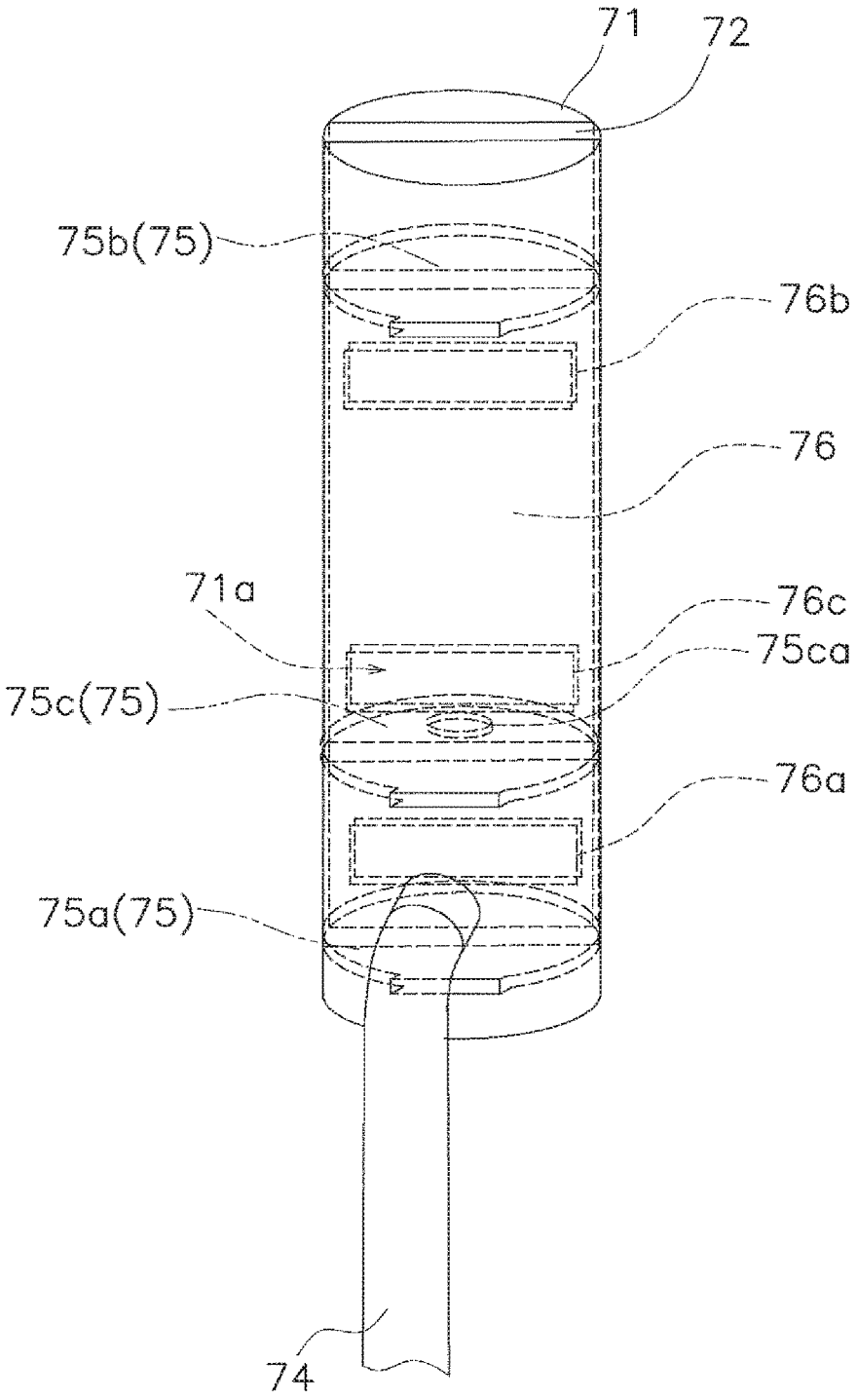
FIG. 11 is a partial enlarged perspective view illustrating the flow of refrigerant through an inside of the inlet/outlet header collecting tube of the first heat exchanger.
Figure 15:
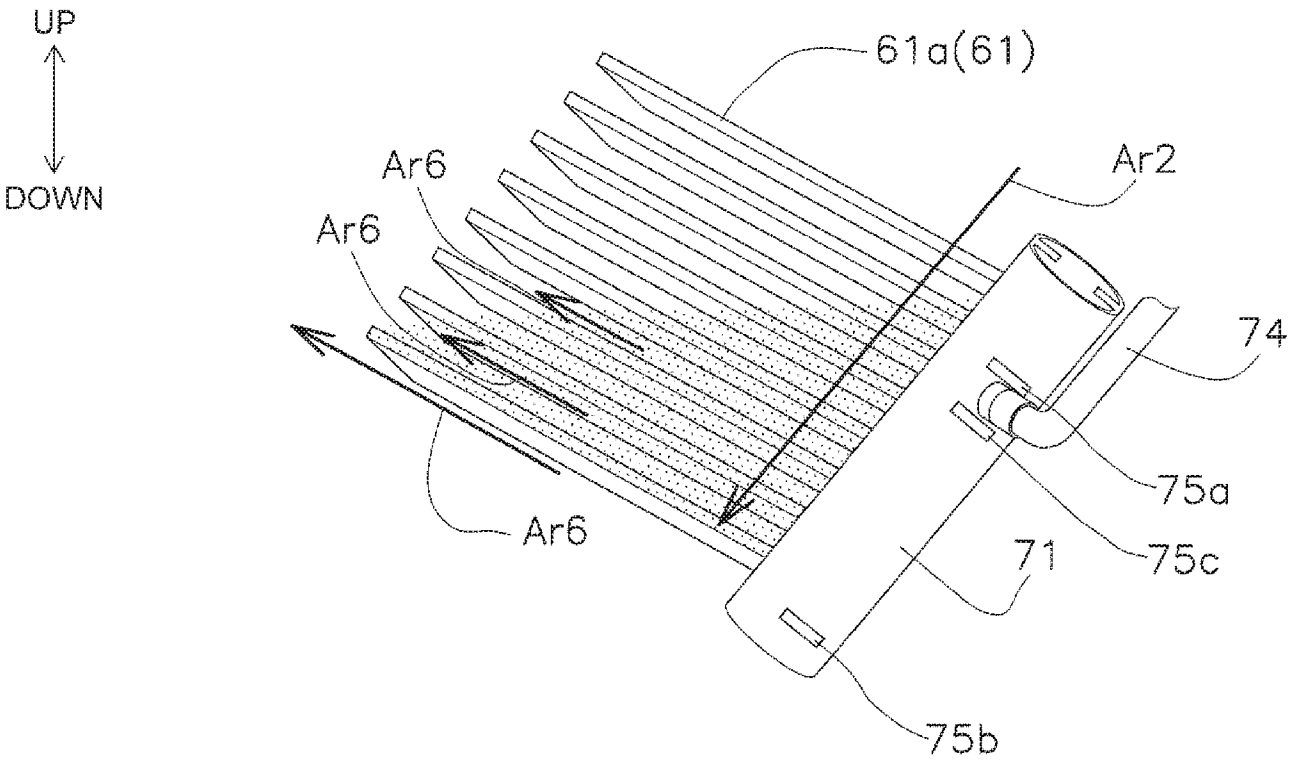
FIG. 15 is a view illustrating the flow of refrigerant when the inlet/outlet header collecting tube and the first flattened tubes are disposed upside-down.

FIG. 15 illustrates a state in which the inlet/outlet header collecting tube 71 illustrated in FIGS. 9 through 11 is upside-down relative to the state thereof in FIGS. 9 through 11. In other words, the inlet/outlet header collecting tube 71 illustrated in FIG. 15 is disposed so that the lower part thereof below the boundary line BL in FIG. 8 is positioned on the upper side and the upper part thereof is positioned at the lower side, and refrigerant entering from the inlet pipings 74 flows into the first flattened tubes 61*a* while flowing along a direction from the upper side to lower side (direction indicated by an arrow Ar2). Liquid refrigerant included in the refrigerant entering from the inlet pipings 74 mostly flows downward by gravity, and also in the plurality of first flattened tubes 61*a* connected to the inlet/outlet header collecting tube 71, the refrigerant flow rate is greater the lower the position thereof is. A region in which there is more liquid refrigerant is represented by dot hatching in FIG. 15. The length of the arrows Ar6 in FIG. 15 represents the magnitude of the refrigerant flow rate. When the refrigerant flows into the plurality of first flattened tubes 61*a* while moving downward through the inlet/outlet header collecting tube 71 in this manner, the refrigerant accumulates below the inlet pipings 74 leading into the inlet/outlet header collecting tube 71, and distribution performance is reduced.

In contrast with the state illustrated in FIG. 15, in the inlet/outlet header collecting tubes 71 of the first heat exchanger 31 and the second heat exchanger 32 illustrated in FIGS. 14(*a*) and 14(*b*), the arrow Ar2 is oriented from the lower side to the upper side in both the vertical attitude and the horizontal attitude for both the inlet/outlet header collecting tubes 71, and refrigerant is distributed to the plurality of first flattened tubes 61 in the manner indicated by the arrows Ar6 while being spouted upward. The liquid refrigerant is therefore appropriately distributed to the plurality of first flattened tubes 61 without accumulating in a portion of the inlet/outlet header collecting tube 71, and good distribution performance is ensured.

(2-3) Fan 41

A sirocco fan is used as the fan 41 herein, but a centrifugal fan, an axial fan, or a cross flow fan, for example, may also be used. The fan 41 draws in air from left and right openings 42, and generates an upward air flow AF1 (see FIG. 4) blown out upward from the vent 28 and generates an air flow AF2 drawn into the suction port 27 from below during vertical use, as illustrated in FIG. 2. During horizontal use as illustrated in FIG. 3, an air flow is blown out toward the left side from the vent 28. By the drawing in of air flows from the openings 42, a negative pressure in which air pressure is lower than the atmospheric pressure occurs in an upper space S1 of the first heat exchanger 31 and the second heat exchanger 32 in the vertical attitude.

Partition plates 91 configured from substantially right-triangular aluminum plates are provided at a front end and a rear end of the first heat exchanger 31, partition plates 93 are provided to a right side and an upper part of the first heat exchanger 31 in the vertical attitude, and a suction flow channel continuing from the suction port 27 to the first heat exchanger 31 is formed by the partition plates 91, 93. Partition plates 92 configured from substantially right-triangular aluminum plates are also provided at a front end and a rear end of the second heat exchanger 32, partition plates 94 are provided to a right side and an upper part of the second heat exchanger 32 in the vertical attitude, and a suction flow channel continuing from the suction port 27 to the second heat exchanger 32 is formed by the partition plates 92, 94. Consequently, during vertical use, a left-inclined upward air flow AF3 along a cross-sectional longitudinal direction of the first flattened tubes 61 and the second flattened tubes 66 is generated upstream from the first heat exchanger 31 and the second heat exchanger 32 by driving of the fan 41, and an upward air flow AF4 is generated downstream from the first heat exchanger 31 and the second heat exchanger 32 (see FIG. 6) by driving of the fan 41. During horizontal use, a right-inclined downward air flow AF5 along the cross-sectional longitudinal direction of the first flattened tubes 61 and the second flattened tubes 66 is generated upstream from the first heat exchanger 31 and the second heat exchanger 32 by driving of the fan 41, and a leftward air flow AF6 is generated downstream from the first heat exchanger 31 and the second heat exchanger 32 (see FIG. 6) by driving of the fan 41.

(2-4) Drain Pans 51 through 54

Figure 12:
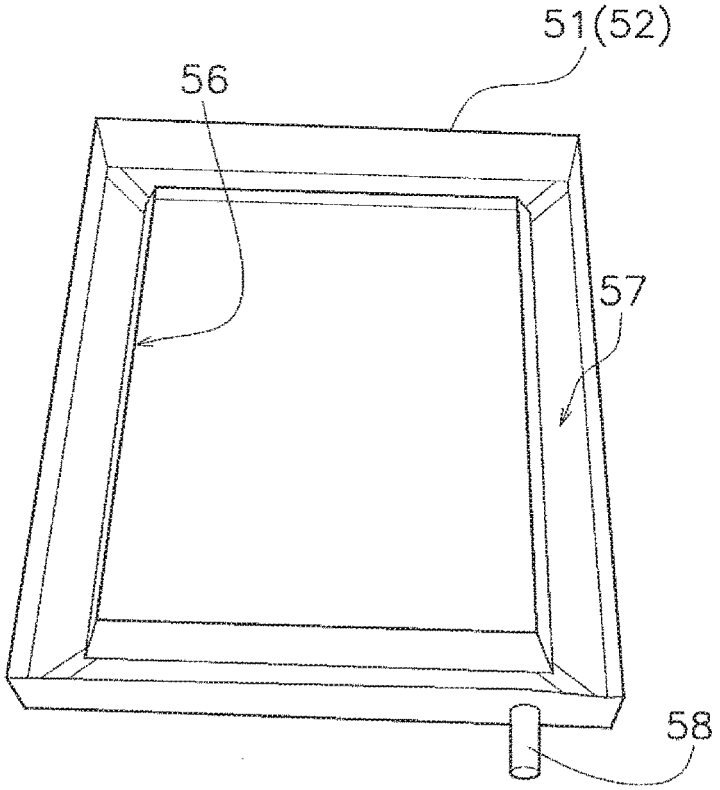
FIG. 12 is a perspective view illustrating an example of the configuration of a bottom-face first drain pan and a bottom-face second drain pan.

The bottom-face first drain pan 51 is the drain pan that is below the first heat exchanger 31 and that primarily receives and drains condensed water generated by the first heat exchanger 31 when the heat exchange unit 10 is in the vertical attitude (first attitude). The bottom-face second drain pan 52 is the drain pan that is below the second heat exchanger 32 and that primarily receives and drains condensed water generated by the second heat exchanger 32 when the heat exchange unit 10 is in the vertical attitude. As illustrated in FIG. 12, an opening 56 for forming the suction port 27 is provided in a center of each of the bottom-face first drain pan 51 and the bottom-face second drain pan 52. A water channel 57 is provided so as to surround an entire periphery of the opening 56, and a drain port 58 is connected to the water channel 57.

Figure 13:
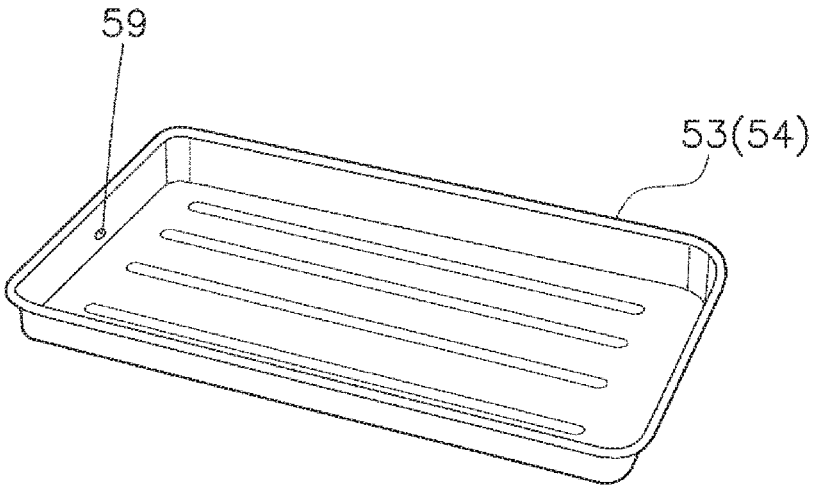
FIG. 13 is a perspective view illustrating an example of the configuration of a left-face first drain pan and a left-face second drain pan.

The left-face first drain pan 53 is the drain pan that is below the first heat exchanger 31 and that primarily receives and drains condensed water generated by the first heat exchanger 31 when the heat exchange unit 10 is in the horizontal attitude (second attitude). The left-face second drain pan 54 is the drain pan that is below the second heat exchanger 32 and that primarily receives and drains condensed water generated by the second heat exchanger 32 when the heat exchange unit 10 is in the horizontal attitude (second attitude). As illustrated in FIG. 13, the left-face first drain pan 53 and the left-face second drain pan 54 are dish-shaped drain pans, and are provided with a drain port 59.

The bottom-face first drain pan 51 and the left-face first drain pan 53 described above are first drain pans disposed under the first heat exchanger 31 when the heat exchange unit is in the first attitude and the second attitude. When the second heat exchanger 32 is configured as a second heat exchanger, the bottom-face second drain pan 52 and the left-face second drain pan 54 described above are second drain pans disposed under the second heat exchanger 32 when the heat exchange unit is in the first attitude and the second attitude. The first drain pans are configured from two members (the bottom-face first drain pan 51 and the left-face first drain pan 53) herein, but the first drain pans may also be configured from a single member having the function of the first drain pans. In the same manner, the second drain pans are configured from two members (the bottom-face second drain pan 52 and the left-face second drain pan 54) herein, but the second drain pans may also be configured from a single member having the function of the second drain pans.

(3) Modifications (3-1) Modification 1A

In the above embodiment, a case is described in which the first heat exchanger 31 and the second heat exchanger 32 are disposed parallel to each other, but the first heat exchanger 31 and the second heat exchanger 32 may also be in a non-parallel arrangement. The angle at which the first heat exchanger 31 and second heat exchanger 32 meet the bottom face 21 may be changed while the first heat exchanger 31 and the second heat exchanger 32 are inclined downward to the left as viewed from the front when the heat exchange unit 10 is in the vertical attitude. For example, the angle at which the second heat exchanger 32 meets the bottom face 21 may be set to (a+2) degrees or (a−3) degrees, where a (degrees) is the angle at which the first heat exchanger 31 meets the bottom face 21.

(3-2) Modification 1B

In the above embodiment, a case is described in which the first heat exchanger 31, the second heat exchanger 32, and the fan 41 are accommodated together in a single casing 20 in the heat exchange unit 10, but a configuration may also be adopted in which the first and second heat exchangers 31, 32 and the fan 41 are separately accommodated in two different casings. In this case, the unit configured from the first heat exchanger 31 and the second heat exchanger 32 accommodated in a casing constitutes a heat exchange unit.

(3-3) Modification 1C

The left-side face 22 is configured as a predetermined side face in the case described in the above embodiment, but a configuration may also be adopted in which the right-side face 23, the front-side face 24, or the rear-side face 25 is configured as the predetermined side face. It is also not necessarily required for the shape of each face of the casing 20 to be flat, and gently curved projections may also be provided in three or four locations as feet for supporting the casing 20, for example.

(3-4) Modification 1D

In the above embodiment, a case is described in which a suction port 27 is provided in the bottom face 21 and a vent 28 is also provided in the top face 26. However, the faces in which the suction port 27 and the vent 28 are formed are not limited to the bottom face 21 and the top face 26, and the top face 26 and the bottom face 21 can be switched when the fan 41 of the heat exchange unit 10 illustrated in FIGS. 1 through 3 is configured so that a ventilation direction of the fan 41 in the vertical attitude is changed so that air is sent from top to bottom side, for example. In a heat exchange unit thus configured, air is drawn in from the top face and blown out from the bottom face. A configuration may also be adopted in which a vent is provided in a side face, for example.

(3-5) Modification 1E

A heat exchange unit 10 provided with two heat exchangers is described in the above embodiment, but the applicability of the present invention is not limited to configurations in which there are two heat exchangers, and the present invention can also be applied to a heat exchange unit provided with three or more heat exchangers.

(4) Features (4-1)

As described above, the heat exchange unit 10 can be installed and used in a first attitude (vertical attitude) and a second attitude (horizontal attitude). The first heat exchanger 31 has the individual space 71*a* (example of a first refrigerant distribution space) of the inlet/outlet header collecting tube 71 including a flow channel through which refrigerant is spouted upward when the heat exchange unit is in the first attitude, and the plurality of first flattened tubes 61 communicating with the individual space 71*a* at different heights (see FIG. 14(*a*)). The second heat exchanger 32 has the individual space 71*b* (example of a second refrigerant distribution space) of the inlet/outlet header collecting tube 71 including a flow channel through which refrigerant is spouted upward when the heat exchange unit is in the first attitude, and the plurality of second flattened tubes 66*a* communicating with the individual space 71*b* at different heights (see FIG. 14(*a*)). As illustrated in FIG. 14(*b*), the first heat exchanger 31 is disposed inside the casing 20 so that refrigerant is spouted upward in the flow channel of the individual space 71*a* also when the casing 20 is installed in the second attitude. The second heat exchanger 32 is also disposed inside the casing 20 so that refrigerant is spouted upward in the flow channel of the individual space 71*b* when the casing 20 is installed in the second attitude. Consequently, as described using FIG. 15, downward spouting by gravity does not occur in the individual spaces 71*a*, 71*b* when the heat exchange unit is in the first attitude or the second attitude. In the first heat exchanger 31 and the second heat exchanger 32, good circulation of refrigerant can be ensured and high heat exchanging capacity is obtained in the first attitude as well as in the second attitude.

(4-2)

In the heat exchange unit 10 described above, both the first heat exchanger 31 and the second heat exchanger 32 are inclined downward to the left in the same manner (see FIG. 2) and are disposed so that lower end parts 31D, 32D are closer to the left-side face 22 (example of the predetermined side face) than upper end parts 31U, 32U when the heat exchange unit is installed in the first attitude. Through this configuration, both the first heat exchanger 31 and the second heat exchanger 32 are disposed so that the upper end parts 31U, 32U are farther from the left-side face 22 than the lower end parts 31D, 32D when the heat exchange unit is installed in the second attitude. Adopting such a configuration makes it possible to easily realize a heat exchange unit 10 which can be installed so that refrigerant is spouted upward in the individual space 71*a* of the first heat exchanger 31 as well as in the individual space 71*b* of the second heat exchanger 32 in not only the first attitude but also the second attitude.

(4-3)

In the heat exchange unit 10 described above, when a heat exchanger in which first fin non-communicating parts such as side parts in which the first notches 64 are formed, for example, and first fin communicating parts 63 are on both sides thereof is turned while maintaining upward spouting, and the attitude thereof is switched between the first attitude and the second attitude, the first fin non-communicating parts face downward. However, such a state can be prevented by providing the first fin communicating parts 63 to both sides of the first flattened tubes 61 as illustrated in FIGS. 6 and 7. In the same manner, when a second heat exchanger in which second fin non-communicating parts such as side parts in which the second notches 69 are formed, for example, and second fin communicating parts 68 are on both sides thereof is turned while maintaining upward spouting, and the attitude thereof is switched between the first attitude and the second attitude, the second fin non-communicating parts face downward. However, such a state can be prevented by providing the second fin communicating parts 68 to both sides of the second flattened tubes 66. Through this configuration, it is possible to reduce a deterioration in heat exchanging capacity of the first heat exchanger 31 and the second heat exchanger 32 due to accumulation of condensed water in the first fin non-communicating parts and the second fin non-communicating parts.

(4-4)

In the heat exchange unit 10 described above, the plurality of first fins 62 of the first heat exchanger 31 are arranged so as to be divided into two columns including first fins 62*a* of the right-side column 31*a* and first fins 62*b* of the left-side column 31*b*. In the same manner, the plurality of second fins 67 of the second heat exchanger 32 are arranged so as to be divided into two columns including second fins 67*a* of the right-side column 32*a* and second fins 67*b* of the left-side column 32*b*. The first notches 64 in the first fins 62*a* of the right-side column 31*a* and the first notches 64 in the first fins 62*b* of the left-side column 31*b* are disposed so as to face each other. In the same manner, the second notches 69 in the second fins 67*a* of the right-side column 32*a* and the second notches 69 in the second fins 67*b* of the left-side column 32*b* are disposed so as to face each other. The first fin communicating parts 63 on a reverse side from the first notches 64 can be disposed on both sides of the first heat exchanger 31, and the second fin communicating parts 68 on a reverse side from the second notches 69 can be disposed on both sides of the second heat exchanger 32, and a heat exchange unit 10 having good drainage performance in both the first attitude and the second attitude is therefore easily realized.

(4-5)

In the heat exchange unit 10 described above, the left-face second drain pan 54 is provided as a second drain pan extending between the first heat exchanger 31 and the second heat exchanger 32 when the heat exchange unit is in the second attitude, and the left-face second drain pan 54 can therefore catch condensed water generated in the second heat exchanger 32 so that the condensed water generated in the second heat exchanger 32 does not come to the first heat exchanger 31. As a result, it is possible to suppress a reduction in heat exchanging capacity in the first heat exchanger 31 due to movement of condensed water generated in the second heat exchanger 32 to the first heat exchanger 31.

REFERENCE SIGNS LIST

10 heat exchange unit
20 casing
31 first heat exchanger
32 second heat exchanger
51 bottom-face first drain pan (example of first drain pan)
52 bottom-face second drain pan (example of second drain pan)
53 left-face first drain pan (example of first drain pan)
54 left-face second drain pan (example of second drain pan)
61 first flattened tubes
62 first fins
63 first fin communicating parts
64 first notches
66 second flattened tubes
67 second fins
68 second fin communicating parts
69 second notches

CITATION LIST

Patent Literature

<Patent Literature 1>

Japanese Laid-open Patent Application Publication No. 2013-164216

The invention claimed is:

1. A heat exchange unit usable in a first attitude in an installed state and usable in a second attitude in another installed state, the heat exchange unit comprising:

a casing having a bottom face facing downward when the heat exchange unit is installed in the first attitude, and a predetermined side face intersecting with the bottom face, the predetermined side face facing downward when the heat exchange unit is in the second attitude;

a first heat exchanger disposed inside the casing so that an inclined installation thereof is possible in both the first attitude and the second attitude; and a second heat exchanger disposed inside the casing so that an inclined installation thereof is possible in both the first attitude and the second attitude;

the first heat exchanger having a first refrigerant distribution space including a flow channel through which refrigerant is spouted upward when the heat exchange unit is in the first attitude, and a plurality of first flattened tubes communicating with the first refrigerant distribution space at different heights;

the second heat exchanger having a second refrigerant distribution space including a flow channel through which refrigerant is spouted upward when the heat exchange unit is in the first attitude, and a plurality of second flattened tubes communicating with the second refrigerant distribution space at different heights;

the first heat exchanger being disposed inside the casing so that refrigerant is spouted upward in the flow channel of the first refrigerant distribution space also when the casing is installed in the second attitude; and the second heat exchanger being disposed inside the casing so that refrigerant is spouted upward in the flow channel of the second refrigerant distribution space also when the casing is installed in the second attitude.

2. The heat exchange unit according to claim 1, wherein the first heat exchanger and the second heat exchanger are disposed so as to be inclined in the same direction and are disposed so that lower end parts thereof are closer to the predetermined side face than upper end parts thereof when the casing is installed in the first attitude.

3. The heat exchange unit according to claim 1, wherein the first heat exchanger further has a plurality of first fins fitted into the plurality of first flattened tubes so as to intersect with the first flattened tubes, first fin communicating parts being formed on both sides of the first flattened tubes in a cross-sectional longitudinal direction thereof; and the second heat exchanger further has a plurality of second fins fitted into the plurality of second flattened tubes so as to intersect with the second flattened tubes, second fin communicating parts being formed on both sides of the second flattened tubes in a cross-sectional longitudinal direction thereof.

4. The heat exchange unit according to claim 3, wherein in the first heat exchanger, a plurality of first notches are formed for inserting the plurality of first flattened tubes into the plurality of first fins, the plurality of first flattened tubes and the plurality of first fins are arranged in two columns, and the plurality of first notches of a first column of the plurality of first fins and the plurality of first notches of a second column of the plurality of first fins are disposed so as to face each other; and in the second heat exchanger, a plurality of second notches are formed for inserting the plurality of second flattened tubes into the plurality of second fins, the plurality of second flattened tubes and the plurality of second fins are arranged in two columns, and the plurality of second notches of a first column of the plurality of second fins and the plurality of second notches of a second column of the plurality of second fins are disposed so as to face each other.

5. The heat exchange unit according to claim 1, further comprising:

a first drain pan configured so as to be disposed under the first heat exchanger in both the first attitude and the second attitude in order to catch condensed water from the first heat exchanger; and a second drain pan configured so as to be disposed under the second heat exchanger in both the first attitude and the second attitude in order to catch condensed water from the second heat exchanger;

the second heat exchanger being configured so as to be positioned above the first heat exchanger when the heat exchange unit is in the second attitude; and the second drain pan being configured so as to extend between the first heat exchanger and the second heat exchanger when the heat exchange unit is in the second attitude.

6. The heat exchange unit according to claim 2, wherein the first heat exchanger further has a plurality of first fins fitted into the plurality of first flattened tubes so as to intersect with the first flattened tubes, first fin communicating parts being formed on both sides of the first flattened tubes in a cross-sectional longitudinal direction thereof; and the second heat exchanger further has a plurality of second fins fitted into the plurality of second flattened tubes so as to intersect with the second flattened tubes, second fin communicating parts being formed on both sides of the second flattened tubes in a cross-sectional longitudinal direction thereof.

7. The heat exchange unit according to claim 6, wherein in the first heat exchanger, a plurality of first notches are formed for inserting the plurality of first flattened tubes into the plurality of first fins, the plurality of first flattened tubes and the plurality of first fins are arranged in two columns, and the plurality of first notches of a first column of the plurality of first fins and the plurality of first notches of a second column of the plurality of first fins are disposed so as to face each other; and in the second heat exchanger, a plurality of second notches are formed for inserting the plurality of second flattened tubes into the plurality of second fins, the plurality of second flattened tubes and the plurality of second fins are arranged in two columns, and the plurality of second notches of a first column of the plurality of second fins and the plurality of second notches of a second column of the plurality of second fins are disposed so as to face each other.

8. The heat exchange unit according to claim 2, further comprising:

a first drain pan configured so as to be disposed under the first heat exchanger in both the first attitude and the second attitude in order to catch condensed water from the first heat exchanger; and a second drain pan configured so as to be disposed under the second heat exchanger in both the first attitude and the second attitude in order to catch condensed water from the second heat exchanger;

the second heat exchanger being configured so as to be positioned above the first heat exchanger when the heat exchange unit is in the second attitude; and the second drain pan being configured so as to extend between the first heat exchanger and the second heat exchanger when the heat exchange unit is in the second attitude.

9. The heat exchange unit according to claim 3, further comprising:

a first drain pan configured so as to be disposed under the first heat exchanger in both the first attitude and the second attitude in order to catch condensed water from the first heat exchanger; and a second drain pan configured so as to be disposed under the second heat exchanger in both the first attitude and the second attitude in order to catch condensed water from the second heat exchanger;

the second heat exchanger being configured so as to be positioned above the first heat exchanger when the heat exchange unit is in the second attitude; and the second drain pan being configured so as to extend between the first heat exchanger and the second heat exchanger when the heat exchange unit is in the second attitude.

10. The heat exchange unit according to claim 4, further comprising:

a first drain pan configured so as to be disposed under the first heat exchanger in both the first attitude and the second attitude in order to catch condensed water from the first heat exchanger; and a second drain pan configured so as to be disposed under the second heat exchanger in both the first attitude and the second attitude in order to catch condensed water from the second heat exchanger;

the second heat exchanger being configured so as to be positioned above the first heat exchanger when the heat exchange unit is in the second attitude; and the second drain pan being configured so as to extend between the first heat exchanger and the second heat exchanger when the heat exchange unit is in the second attitude.

11. The heat exchange unit according to claim 6, further comprising:

a first drain pan configured so as to be disposed under the first heat exchanger in both the first attitude and the second attitude in order to catch condensed water from the first heat exchanger; and a second drain pan configured so as to be disposed under the second heat exchanger in both the first attitude and the second attitude in order to catch condensed water from the second heat exchanger;

the second heat exchanger being configured so as to be positioned above the first heat exchanger when the heat exchange unit is in the second attitude; and the second drain pan being configured so as to extend between the first heat exchanger and the second heat exchanger when the heat exchange unit is in the second attitude.

12. The heat exchange unit according to claim 7, further comprising:

a first drain pan configured so as to be disposed under the first heat exchanger in both the first attitude and the second attitude in order to catch condensed water from the first heat exchanger; and a second drain pan configured so as to be disposed under the second heat exchanger in both the first attitude and the second attitude in order to catch condensed water from the second heat exchanger;

the second heat exchanger being configured so as to be positioned above the first heat exchanger when the heat exchange unit is in the second attitude; and the second drain pan being configured so as to extend between the first heat exchanger and the second heat exchanger when the heat exchange unit is in the second attitude.

* * * * *